US011846435B2

(12) United States Patent
Raghavachari

(10) Patent No.: US 11,846,435 B2
(45) Date of Patent: Dec. 19, 2023

(54) SYSTEM AND METHOD FOR ONLINE ASSESSMENT AND MANIFESTATION (OLAAM) FOR BUILDING ENERGY OPTIMIZATION

(71) Applicant: Sridharan Raghavachari, Canton, MI (US)

(72) Inventor: Sridharan Raghavachari, Canton, MI (US)

( * ) Notice: Subject to any disclaimer, the term of this patent is extended or adjusted under 35 U.S.C. 154(b) by 0 days.

(21) Appl. No.: 18/114,809

(22) Filed: Feb. 27, 2023

(65) Prior Publication Data

US 2023/0296275 A1 Sep. 21, 2023

Related U.S. Application Data

(60) Provisional application No. 63/321,822, filed on Mar. 21, 2022.

(51) Int. Cl.
*F24F 11/47* (2018.01)
*F24F 130/10* (2018.01)

(52) U.S. Cl.
CPC ..... *F24F 11/47* (2018.01); *F24F 2130/10* (2018.01)

(58) Field of Classification Search
CPC ..... F24F 11/47; F24F 2130/10
(Continued)

(56) References Cited

U.S. PATENT DOCUMENTS 6,134,511 A 10/2000 Subbarao
6,487,457 B1 11/2002 Hull et al.
(Continued)

FOREIGN PATENT DOCUMENTS

CN 108123842 A 6/2018
CN 104834242 B 7/2018
(Continued)

OTHER PUBLICATIONS

International Search Report dated May 23, 2023 for corresponding International Application No. PCT/US2023/014149, filed Feb. 28, 2023.
(Continued)

*Primary Examiner* — Chun Cao
(74) *Attorney, Agent, or Firm* — David D. Brush; Westman, Champlin & Koehler, P.A

(57) ABSTRACT

A method includes receiving, in a computer, a digital screen capture of a representation of a heating, ventilation and air conditioning (HVAC) system depicting different elements of the HVAC system, interconnections between the different elements, and current operating parameters employed for the different elements. The method also includes performing, by a processor of the computer, an image recognition operation on the digital screen capture that identifies the depicted elements, and recognizes the depicted current operating parameters for the different depicted elements. The method further includes analyzing, by the processor of the computer, the different recognized current operating parameters to determine current energy consumption values for the HVAC system. Obtainable energy savings values for the HVAC system are calculated based on the identified depicted elements, the different recognized current operating parameters, and the current energy consumption values, and the energy savings values are output.

21 Claims, 19 Drawing Sheets

(58) Field of Classification Search
USPC ..... 700/276
See application file for complete search history.

(56) References Cited

U.S. PATENT DOCUMENTS

| | | | | |
|---|---|---|---|---|
| 8,947,437 | B2 | 2/2015 | Garr et al. | |
| 9,396,293 | B2 | 7/2016 | Sons et al. | |
| 9,417,637 | B2 | 8/2016 | Matsuoka et al. | |
| 9,429,923 | B2 | 8/2016 | Ward et al. | |
| 9,519,393 | B2 | 12/2016 | Grossele et al. | |
| 9,929,872 | B2 | 3/2018 | Keenan, Jr. et al. | |
| 10,534,326 | B2 | 1/2020 | Sridharan et al. | |
| 11,522,364 | B2 | 12/2022 | Hu | |
| 2001/0020219 | A1 | 9/2001 | Kishlock et al. | |
| 2003/0171851 | A1 | 9/2003 | Brickfield et al. | |
| 2007/0239477 | A1* | 10/2007 | Budike, Jr. | G06Q 30/0633 705/412 |
| 2009/0187445 | A1 | 7/2009 | Barclay et al. | |
| 2010/0070907 | A1* | 3/2010 | Harrod | F24F 11/30 700/277 |
| 2010/0114550 | A1 | 5/2010 | Fujihara et al. | |
| 2010/0283606 | A1 | 11/2010 | Tsypin et al. | |
| 2011/0160913 | A1* | 6/2011 | Parker | F24D 19/1048 700/291 |
| 2011/0251933 | A1 | 10/2011 | Egnor et al. | |
| 2012/0259469 | A1 | 10/2012 | Ward et al. | |
| 2013/0144444 | A1* | 6/2013 | Ligeret | G05B 17/02 700/276 |
| 2014/0217185 | A1 | 8/2014 | Bicknell | |
| 2015/0178865 | A1 | 6/2015 | Anderson et al. | |
| 2016/0290670 | A1* | 10/2016 | Dempsey | G01R 22/10 |
| 2016/0327295 | A1 | 11/2016 | Ward et al. | |
| 2018/0206096 | A1* | 7/2018 | Sharma | H04L 67/55 |
| 2018/0218540 | A1* | 8/2018 | Sridharan | H04N 7/181 |
| 2019/0032942 | A1* | 1/2019 | Willmott | F24F 11/46 |
| 2019/0032948 | A1 | 1/2019 | Nayak et al. | |
| 2019/0302157 | A1* | 10/2019 | Vitullo | G01K 17/20 |
| 2019/0356502 | A1 | 11/2019 | Nair et al. | |
| 2020/0355390 | A1* | 11/2020 | Chen | F24F 11/54 |
| 2022/0041697 | A1 | 2/2022 | Sigurdsson | |

FOREIGN PATENT DOCUMENTS

| | | | |
|---|---|---|---|
| JP | 2008090828 | A | 4/2008 |
| JP | 5663596 | B2 | 2/2015 |

OTHER PUBLICATIONS

Written Opinion of the International Searching Authority dated May 23, 2023 for corresponding International Application No. PCT/US2023/014149, filed Feb. 28, 2023.

Hilliard et al., "Using Building Simulation Software to Quantify the Savings of a Model Predictive Control Implementation", 2016, 9 pages.

Felsmann et al., "Reduced order building energy system modeling in large-scale energy system simulations", Proceedings of BS2013: 13th Conference of International Building Performance Simulation Association, Chambéry, France, Aug. 26-28, 2013, 8 pages.

Brideau, "Estimating Hourly Heating and Cooling Loads from Monthly Results", 2020, 8 pages.

Monfet et al., "Calibration of a Building Energy Model Using Measured Data", Coversheet, ASHRAE Transactions, 2009, vol. 115 Issue 1, 1 page (Abstract only).

* cited by examiner

SYSTEM AND METHOD FOR ONLINE ASSESSMENT AND MANIFESTATION (OLAAM) FOR BUILDING ENERGY OPTIMIZATION

CROSS REFERENCE TO RELATED APPLICATIONS

This application claims the benefit of U.S. provisional application 63/321,822 filed on Mar. 21, 2022, the content of which is hereby incorporated in its entirety.

SUMMARY

In first embodiment, a method is provided. The method includes receiving, in a computer, a digital screen capture of a representation of a heating, ventilation and air conditioning (HVAC) system depicting different elements of the HVAC system, interconnections between the different elements, and current operating parameters employed for the different elements. The method also includes performing, by a processor of the computer, an image recognition operation on the digital screen capture that identifies the depicted elements, and recognizes the depicted current operating parameters for the different depicted elements. The method further includes analyzing, by the processor of the computer, the different recognized current operating parameters to determine current energy consumption values for the HVAC system. Obtainable energy savings values for the HVAC system are calculated based on the identified depicted elements, the different recognized current operating parameters, and the current energy consumption values, and the energy savings values are output.

In second embodiment, a system is provided. The system includes a memory configured to store a heating, ventilation and air conditioning (HVAC) system database, and a processor communicatively coupled to the memory. The processor is configured to receive a digital screen capture of a representation of HVAC system depicting different elements of the HVAC system, interconnections between the different elements, current operating parameters employed for the different elements, and outdoor ambient conditions of the environment in which the HVAC system is employed. The processor is also configured to perform an image recognition operation on the digital screen capture that compares the depicted different elements of the HVAC system with elements in the HVAC system database to identify the depicted elements, recognizes, using the HVAC system database, the depicted current operating parameters for the different depicted elements, and recognizes, using the HVAC system database, the depicted outdoor ambient conditions of the environment in which the HVAC system is employed. The processor is further configured to analyze the different recognized current operating parameters to determine current energy consumption values for the HVAC system. The processor calculates obtainable energy savings values for the HVAC system based on the identified depicted elements, the different recognized current operating parameters, and the current energy consumption values, and output the energy savings values.

In third embodiment, a method is provided. The method includes providing a high-level energy savings estimate for a heating, ventilation and air conditioning (HVAC) system, and providing a detailed energy savings estimate for the HVAC system. The detailed energy savings estimate for the HVAC system is provided by a method that includes receiving, in a computer, a digital screen capture of a representation of the HVAC system depicting different elements of the HVAC system, interconnections between the different elements, current operating parameters employed for the different elements, and outdoor ambient conditions of the environment in which the HVAC system is employed. The method also includes performing, by a processor of the computer, an image recognition operation on the digital screen capture that compares the depicted different elements of the HVAC system with elements in a HVAC system database to identify the depicted elements, recognizes, using the HVAC system database, the depicted current operating parameters for the different depicted elements, and recognizes, using the HVAC system database, the depicted outdoor ambient conditions of the environment in which the HVAC system is employed. The method further includes analyzing, by the processor of the computer, the different recognized current operating parameters to determine current energy consumption values for the HVAC system. Obtainable energy savings values for the HVAC system are calculated based on the identified depicted elements, the different recognized current operating parameters, and the current energy consumption values, the calculated energy savings values that constitute that detailed energy savings are output.

In a fourth embodiment, a method is provided. The method includes obtaining, by a processor of a computer, an inventory list of a heating, ventilation and air conditioning (HVAC) system of a customer. The method also includes obtaining, by the processor of the computer, a location of the HVAC system of the customer, and utility rates for the location of the HVAC system of the customer. The method further includes dynamically obtaining, by the processor of the computer, atmospheric conditions for the location of the HVAC system of the customer. Current energy savings values for the HVAC system are dynamically calculated by the processor of the computer based on the inventory list, the utility rates, and the dynamically obtained atmospheric conditions for the location of the HVAC system of the customer. The dynamically calculated energy savings values are output are displayed by the computer as part of a simulation showing a comparison of current energy consumption to simulated energy consumption.

Other features and benefits that characterize embodiments of the disclosure will be apparent upon reading the following detailed description and review of the associated drawings.

Figure 1:
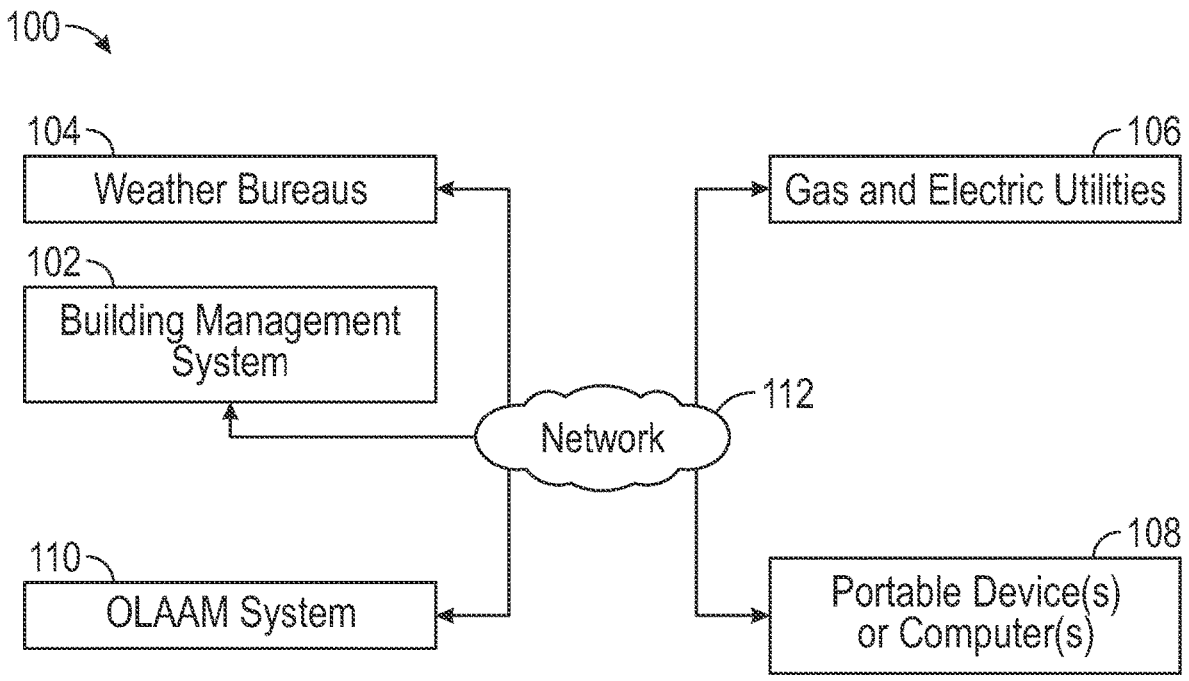
FIG. 1 is a simplified block diagram that illustrates an online assessment and manifestation (OLAAM) architecture in accordance with one embodiment.

The figures may not be drawn to scale. In particular, some features may be enlarged relative to other features for clarity. Moreover, where terms such as above, below, over, under, top, bottom, side, right, left, vertical, horizontal, etc., are used, it is to be understood that they are used only for ease of understanding the description. It is contemplated that structures may be oriented otherwise.

DETAILED DESCRIPTION OF ILLUSTRATIVE EMBODIMENTS

Embodiments of the disclosure relate to systems and methods for online assessment and manifestation (OLAAM) for building energy optimization. As will be described in detail further below, embodiments of the disclosure determine an energy savings potential for a building by electronically analyzing building management system screens and/or other information without a technician having to be physically present at the building. Accordingly, such embodiments eliminate or substantially reduce the dilemma faced by commercial building owners/operators (and of other applications) of having to choose from 1) cost saving, 2) privacy and 3) the attitude of "why upset the apple cart (resistance to change)". Embodiments of the disclosure also enable accomplishing the identification and harnessing of the savings potential in a short time frame, and enable the energy efficiency industry to scale up the business without substantial effort and resources. In certain embodiments, a real-time operational simulation is created with the customer's existing equipment with new algorithms created dynamically with the actual current conditions such as relative humidity (RH), dew point temperature, dry bulb temperature, etc., obtainable on a continual or regular basis by the OLAAM program.

The total energy consumption of commercial buildings in the United States alone is over 4.5 trillion kilowatt hours (kWh)/year according to the Energy Information Agency's 2018 survey. Heating, ventilation and air conditioning (HVAC) and refrigeration account for 54% or 2.4 trillion kWh/year of the energy usage in commercial buildings. At an average of $ 0.15/kWh, this amounts to an annual expenditure of $360 billion in commercial buildings. Approximately 757,000 buildings over 25,000 square feet account for greater than $220 billion of amount spent. With an estimated 25-50% of saving in HVAC operations, the energy saving is about $55-110 billion/year. On a two-year payback, the market size is $110-220 billion. Whereas a conventional presently-available energy efficiency optimization tool/controller may take 6 months to two years to complete a single project, the OLAAM system described herein can simultaneously accomplish the tasks of energy efficiency projects for hundreds of buildings, from identification to implementation within a short amount of time (e.g., an hour to fifteen days). As indicated above, the OLAAM system also eliminates the owners'/users' fear of the unknown, the intrusion of their privacies, and prolonged project incubation time.

One or more embodiments of the present system and method enable the owners/users to reduce operational energy costs through:

1) efficient controls disclosed in one or more of the following:
   US 2018/0003180A1, published Jan. 4, 2018;
   U.S. Pat. No. 6,860,103, issued Mar. 1, 2005; and/or
   U.S. Pat. No. 8,660,707, issued Feb. 25, 2014,
   which are incorporated herein in their entireties, and
2) enabling the owners/users to avail an economical "Demand Response" tariff without substantial additional capital cost for ice storage, standby power generation, etc.

Other features and benefits that characterize embodiments of the present disclosure will be apparent upon reading the following detailed description and review of the associated drawings.

It should be noted that the same or similar reference numerals are used in different figures for the same or similar elements. All descriptions of an element also apply to all other versions of that element unless otherwise stated. It should also be understood that the terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps, and do not supply a serial or numerical limitation on the elements or steps of the embodiments thereof. For example, "first," "second," and "third" elements or steps need not necessarily appear in that order, and the embodiments thereof need not necessarily be limited to three elements or steps. It should also be understood that, unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. It should also be understood that the singular forms of "a," "an," and "the" include plural references unless the context clearly dictates otherwise.

It will be understood that, when an element is referred to as being "connected," "coupled," or "attached" to another element, it can be directly connected, coupled or attached to the other element, or it can be indirectly connected, coupled, or attached to the other element where intervening or intermediate elements may be present. In contrast, if an element is referred to as being "directly connected," "directly coupled" or "directly attached" to another element, there are no intervening elements present. Drawings illustrating direct connections, couplings or attachments between elements also include embodiments, in which the elements are indirectly connected, coupled or attached to each other.

Some embodiments may be embodied in hardware and/or in software (including firmware, resident software, microcode, etc.). Consequently, as used herein, the term "signal" may take the form of a continuous waveform and/or discrete value(s), such as digital value(s) in a memory or register. Furthermore, various embodiments may take the form of a computer program product on a computer-usable or computer-readable storage medium having computer-usable or computer-readable program code embodied in the medium for use by or in connection with an instruction execution system. The computer-usable or computer-readable storage medium may be non-transitory.

Embodiments are described below with reference to block diagrams and operational flow charts. It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

FIG. 1 is a simplified block diagram that illustrates an OLAAM architecture 100 in accordance with one embodiment. As can be seen in FIG. 1, a building managements system (BMS) 102, a weather bureau information source 104, a utilities' information source 106, portable device(s) 108, and an OLAAM system 110 communicate over, for example, a cloud network (e.g., the Internet of Things (IoT)) 112 or any other suitable network. It should be noted that although a single network (e.g., cloud network) 112 is shown, multiple networks with multiple network adapters may be employed. OLAAM system 110 is configured to provide a high-level energy savings estimate and/or a detailed energy savings estimate according to the type of information that it receives. In one embodiment, OLAAM system 110 provides a high level-estimate in response to input that it receives from a customer. In such an embodiment, the customer may download an OLAAM system 110 application into a computer (e.g., a portable or mobile device such as 108) and input information requested by the downloaded OLAAM system 110 application. The information received by the OLAAM system 110 application is communicated to the OLAAM system 110 over, for example, network 112. In response to receiving the information, the OLAAM system 110 computes the high-level energy savings estimate as a function of the received input information, weather bureau information and/or utilities' information, and electronically communicates (e.g., via network 112) the computed energy savings potential to the customer. Details regarding types of information requested by the OLAAM system 110 application, and details regarding the content of the high-level energy savings estimate are provided further below. Upon receiving the high-level energy savings estimate, or independently of receiving the high-level energy savings estimate, the customer can obtain a detailed energy savings estimate from OLAAM system 110. A general description of how a detailed energy savings estimate is computed/determined by OLAAM system 110 is included below, and specifics regarding such an embodiment are provided further below.

BMS 102 may include various computer system screens for monitoring and managing building operations, such as managing building HVAC systems. For obtaining the detailed energy savings estimate, screen images of the building operations at the existing BMS 102 and/or any other HVAC system control screens are made available to a remote OLAAM system 110 computer. Also, weather information and utilities' information from sources 104 and 106, respectively, or from the Cloud may be obtained by the OLAAM system 110 computer(s). The weather information may include local weather data at the customer location including historical weather and future weather forecast information. The utilities' information may include the customer's local utility tariff information, and a rate contract between the utility provider and the customer. As will be described in detailed further below, the OLAAM system 110 computer(s) carry out image recognition operations on the available screens, and utilize the recognized images along with weather and utilities' information to identify energy savings opportunities at the customer location. As used herein, image recognition generally includes recognizing elements of a digital screen that may be in any suitable form (e.g., images, characters, line drawings or any other representations of HVAC equipment and/or parameters of the HVAC equipment), and may employ any suitable techniques for recognizing the images, characters, line drawings and/or other representations. After identifying the energy savings opportunity, the OLAAM system 110 computer generates a report and electronically submits a proposal to the customer. Also, after identifying the energy savings opportunity, the OLAAM system 110 computer conducts remote manual and or auto simulation trials after a letter of intent (LOI), with the customer's existing system and demonstrates the savings potential in energy related to HVAC operation alone to the customer. Thus, OLAAM system 110 computers, in conjunction with the weather data, utility tariff data, historical operational data and trends, determines a low operational cost for the customer for the present, and determines, by simulation, suitable operational parameters to achieve the cost. The results of the simulation and the energy savings analysis is reported to the client through communication devices (e.g., portable device(s) 108) such as a mobile phone, a laptop etc. The customer may then enter into a contract with the OLAAM system 110 owner. Upon the customer's acceptance of the contract, the simulated conditions may be put into operation for the length of the contract. Prior to providing specifics regarding image recognition operations and other computations for obtaining the detailed energy savings estimate, an example embodiment for obtaining a high-level energy savings estimate is described below in connection with FIGS. 2 and 3.

Figure 2:
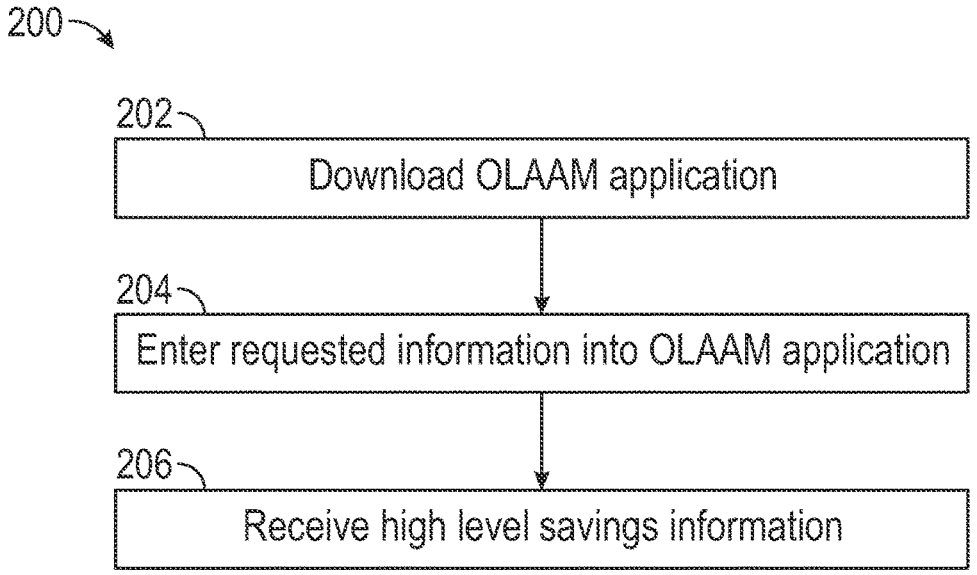
FIG. 2 is a flow diagram of a method of obtaining a high-level energy savings estimate in accordance with one embodiment.

FIG. 2 is a flow diagram of a method 200 of obtaining a high-level energy savings estimate in accordance with one embodiment. At 202, a customer receives an energy savings estimator application or downloads the energy savings estimator application into a computer/mobile device from, for example, an OLAAM system (e.g., 110 of FIG. 1) website. At 204, the customer enters one or more of the following into a screen of the application:

1) Zone improvement plan (ZIP) code,
2) Type of facility,
3) Floor space, and
4) Total (electric, fossil, others, etc.) energy cost.

In response to entering one or more of the above 4 items, at 206, the energy savings estimator application provides the customer with a high-level energy savings estimate. The high-level energy savings estimate may be displayed on a screen of the application or communicated to the customer as a text message/electronic mail message. The high-level energy savings estimate may be a single number or a possible energy savings range.

Figure 3:
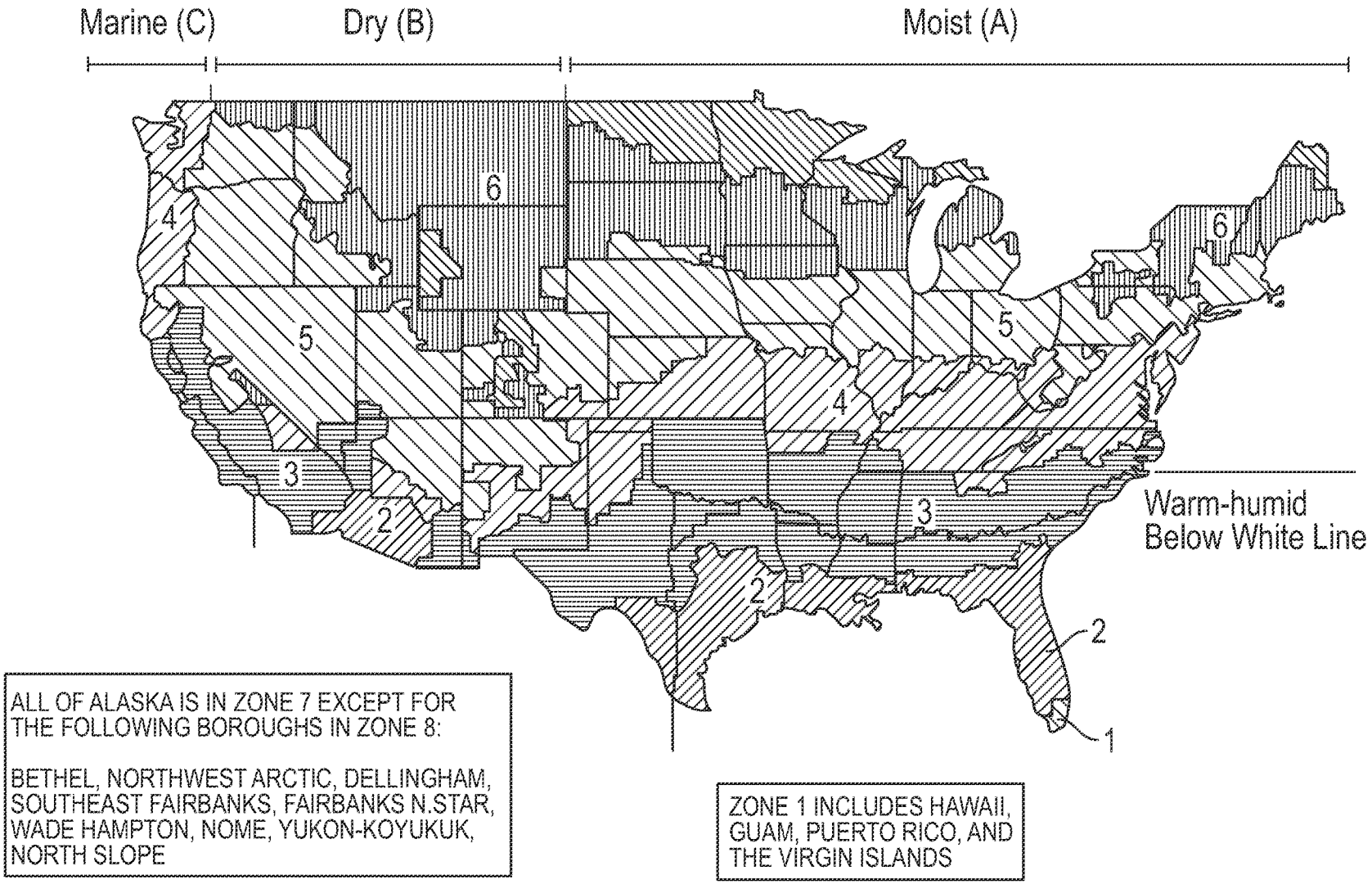
FIG. 3 shows a map of the United States of America with weather zones as defined by the American Society of Heating, Refrigerating and Air-Conditioning Engineers.

In the above embodiment, the ZIP code is employed to identify a weather zone of the location, which, in turn, provides a level of severity of the weather. The weather is an important factor in determining the energy savings potential. FIG. 3 shows a map of the United States of America with weather zones as defined by the American Society of Heating, Refrigerating and Air-Conditioning Engineers (ASHRAE). Once the ZIP is identified by the OLAAM system (e.g., 110 of FIG. 1), the OLAAM system goes on to obtain historical weather data for prior years (e.g., the preceding three years) from the nearest weather station which holds weather records for that location.

Based on the weather zone information in FIG. 3, for example, a hospital in the New York city with a ZIP code 10021 is in zone 4A (mixed temperature and humid) location, whereas a hospital in the city of Miami with a ZIP code of 33166 is in zone 1 (very hot and very humid) location. The high-level savings potential is a medium percentage (%) in New York city and a very low % in Miami.

The type of facility helps in estimating the percentage of energy cost breakdown attributable to HVAC from the total energy cost. A HVAC system in a hospital may account for 30% of the total energy bill, whereas a HVAC system in a five+ star hotel may account for 60% of the energy cost. Table 1 below includes estimated ranges of energy savings by building type.

TABLE 1

Savings % from HVAC Energy portion

| Building Type | Minimum | Maximum | Overall Energy saving % |
|---|---|---|---|
| Hospital | 10% | 20% | 15% |
| Hotel | 20% | 60% | 40% |
| universities/colleges | 20% | 60% | 40% |
| Office buildings | 10% | 20% | 15% |
| Data Centres | 30% | 50% | 40% |
| High Rise Residential | 20% | 60% | 40% |
| Malls | 10% | 20% | 15% |

Providing the floor space helps quantify the energy cost savings more accurately. Table 2 below is an example of energy savings information that the customer will receive (e.g., as a screen displayed to the customer) when the customer enters the location ZIP code, the facility type, and the annual energy cost into the energy savings estimator application.

TABLE 2

High Level Data-To be filled in by Senior Management

| Item # | Brief description | |
|---|---|---|
| 1 | Facility type | Hospital |
| 2 | Facility zip | 10001 |
| 3 | Annual utility amount $ paid | $3,000,000 |
| 4 | Potential savings in $-Min | $240,000 |
| 5 | Potential savings in $-Max | $480,000 |

Once the customer is aware of the high-level energy cost savings shown, for example, in Table 2 above, the customer may sign/register for an OLAAM program with the help of the OLAAM system to obtain a detailed energy savings estimate, and may allow OLAAM to function within the HVAC system operation in accordance with recommendations provided in the detailed energy savings estimate. Of course, the customer may sign/register for the OLAAM program independently of obtaining any high-level energy savings estimate.

Figure 4:
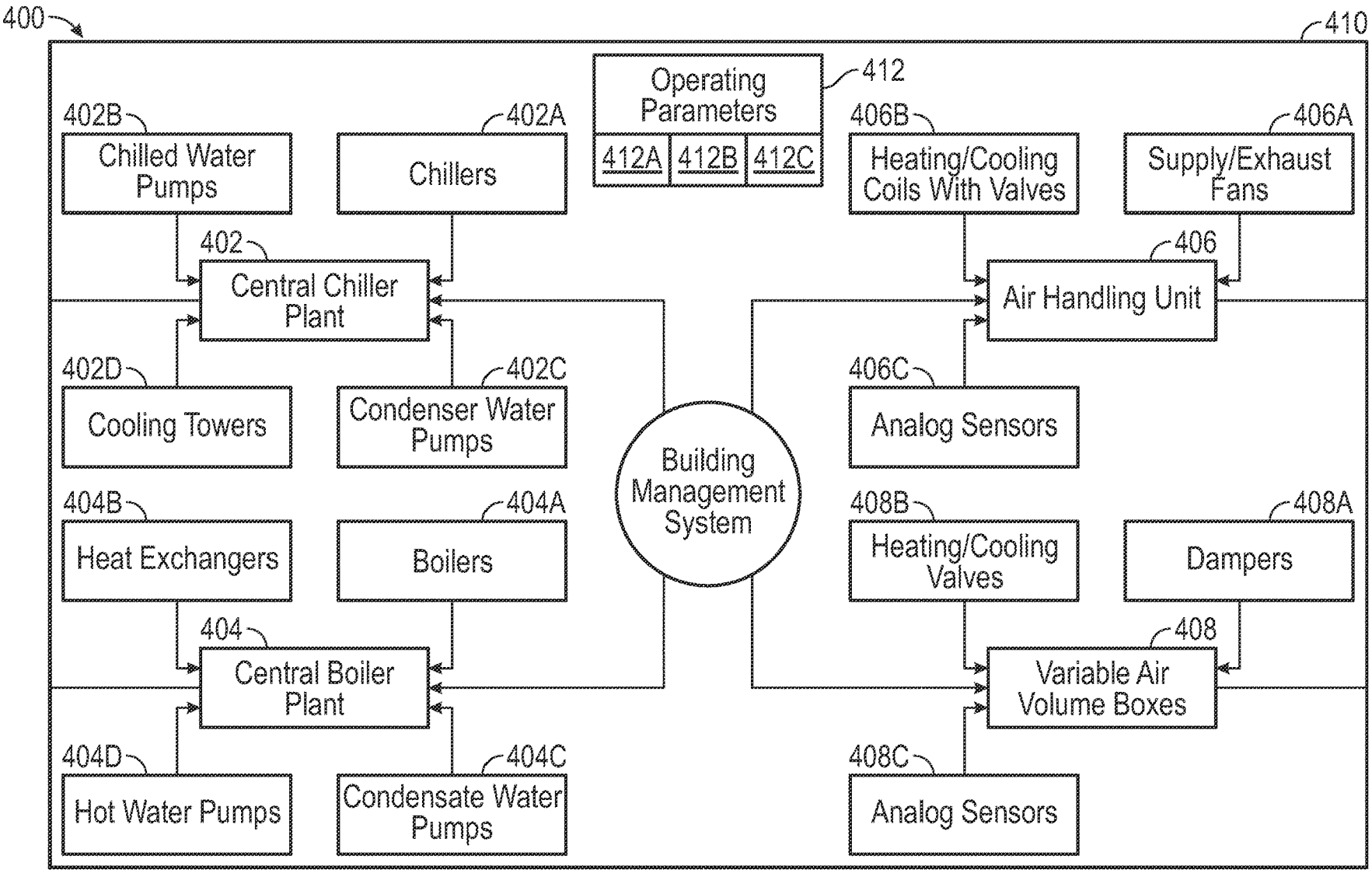
FIG. 4 is a diagrammatic illustration of a building management system (BMS) screen that may be utilized by an OLAAM system to help generate a detailed energy savings estimate in accordance with one embodiment.

FIG. 4 is a diagrammatic illustration of a BMS screen 400 that may be utilized by an OLAAM system to help generate a detailed energy savings estimate in accordance with one embodiment. Screen 400 may depict various HVAC elements (e.g., 402, 404, 406 and 408) that may be connected together by interconnection elements 410. It should be noted that four HVAC elements are shown in screen 400 only in the interest of simplification, and, in general, any suitable number of interconnected HVAC elements may be included in a BMS system screen. Examples of HVAC elements 402 (402A-402D), 404 (404A-404D), 406 (406A-406C) and 408 (408A-408C) include chillers, boilers, pumps, cooling towers, air handling units (AHUs), variable air volume (VAV) boxes, etc. An example of an interconnection element 410 is a fluid pipe. In addition to depicting images of HVAC elements and interconnects 410, screen 400 may also include fields 412 (412A-412C) that display current operating parameters of the respective HVAC elements 402, 404, 406 and 408. In the interest of simplification, only one operating parameter field 412 is shown in FIG. 4. Each operating parameter field 412 may include a number and a unit. Although not shown in FIG. 4, some screens may include additional information such as information about outdoor ambient conditions (e.g., temperature, humidity, etc.) of the environment in which the HVAC system is employed.

As indicated above, a customer (e.g., owner/manager of the BMS system) registers for the OLAAM program prior to obtaining a detailed energy savings estimate. After registration, the customer provides the OLAAM system with access either virtually (online) or via email to one or more BMS screens such as 400. An OLAAM system computer captures as many BMS screens as available (or any suitable number of screens), and performs an image recognition operation on the digital screen capture(s). The image recognition operation may include comparing the depicted different elements (e.g., 402, 404, 406 and 408) with elements in a HVAC system database to identify the depicted elements. The image recognition operation may also include utilizing the HVAC system database to recognize the depicted current operating parameter(s) (e.g., 412) for the different depicted elements. The image recognition operation may further include utilizing the HVAC system database to recognize any other depicted information such as information about outdoor ambient conditions. The recognized images and information may be analyzed by a processor of the computer to determine current energy consumption values for the HVAC system. Thereafter, the processor of the computer may calculate obtainable energy savings values for the HVAC system based on the identified depicted elements, the different recognized current operating parameters, and the current energy consumption values. The computer may then output the energy savings values.

Figure 5:
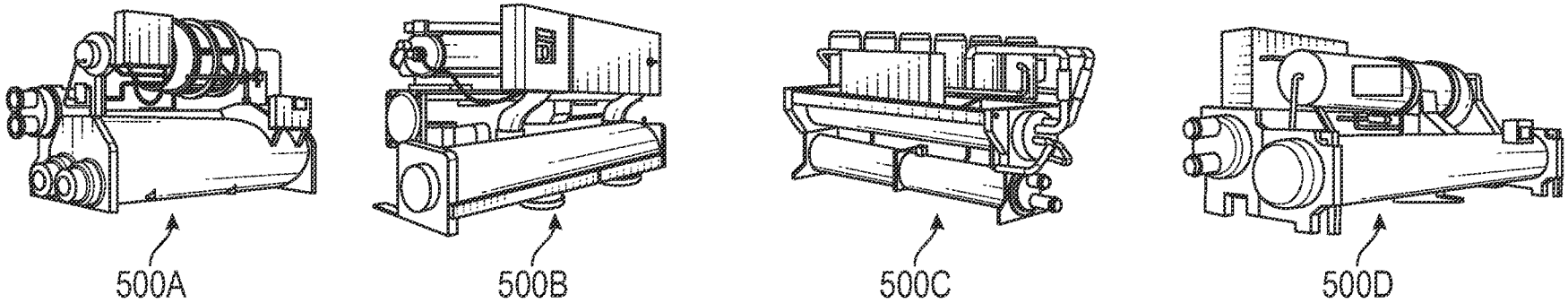
FIG. 5 shows images of a group of water-cooled chillers of various types.
Figure 6:
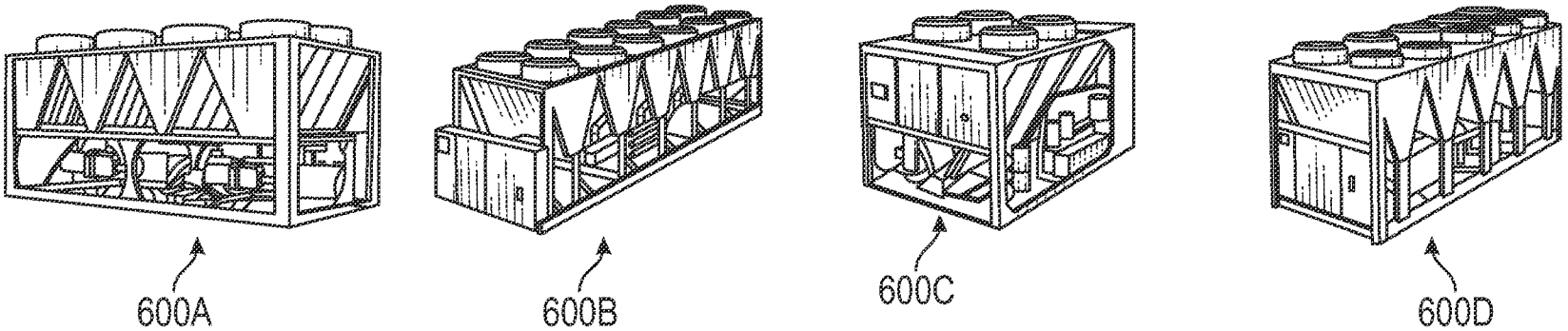
FIG. 6 shows images of a group of air-cooled chillers of various types.
Figure 7:
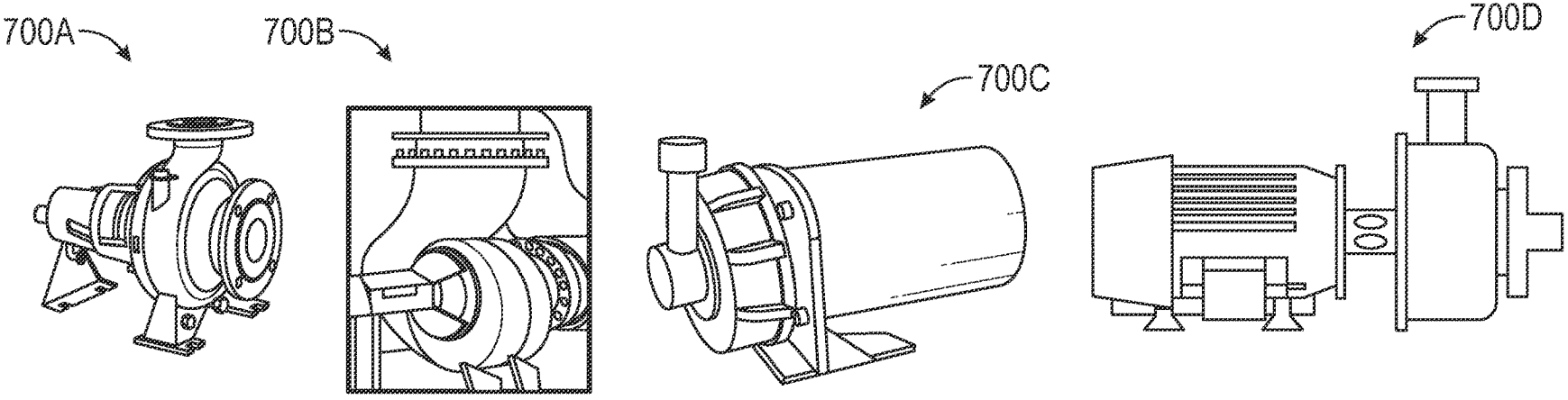
FIG. 7 shows images of pumps of various types.
Figure 8:
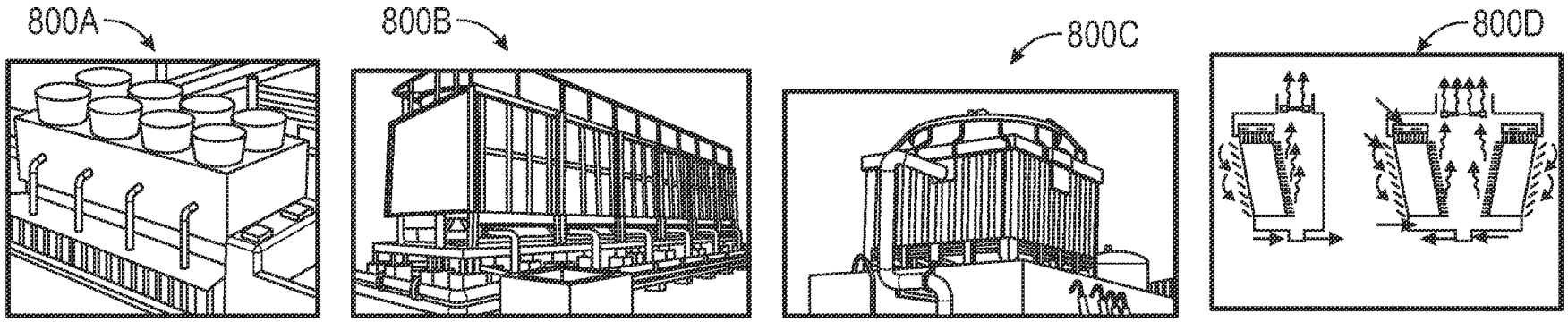
FIG. 8 shows images of cooling towers of various types.
Figure 9:
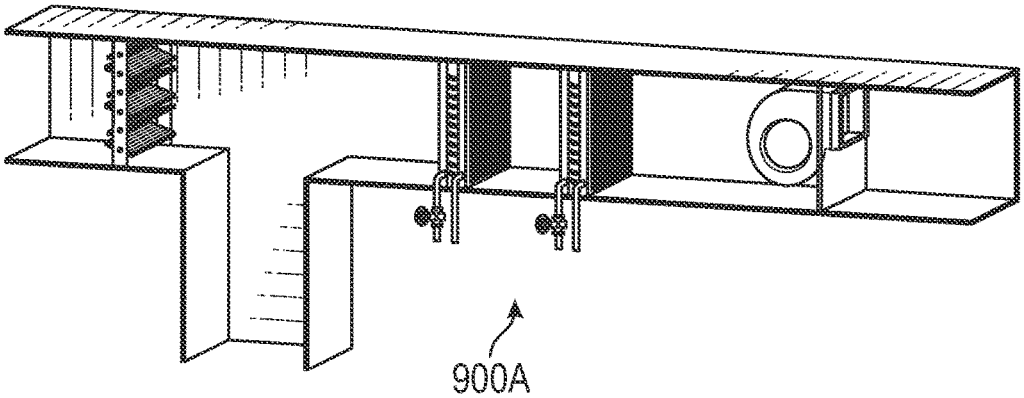
FIG. 9 shows images of air handling unit and a variable air volume box.
Figure 9:
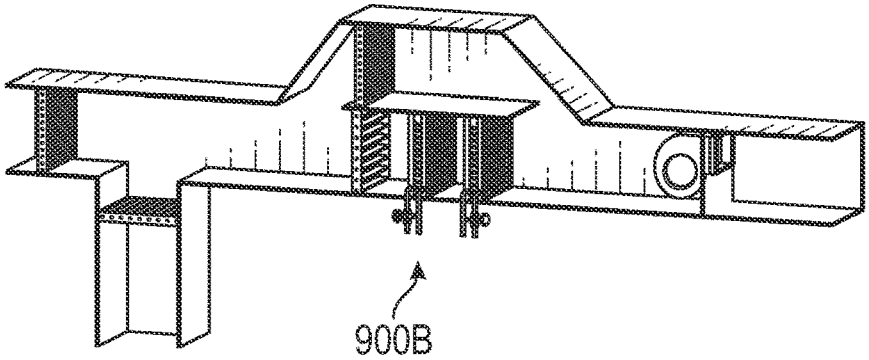
Figure 9:
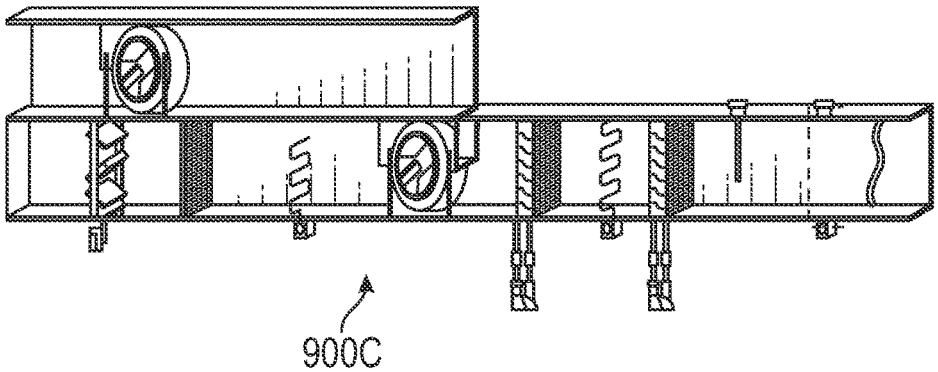
Figure 9:
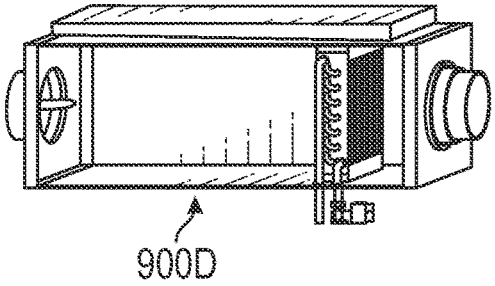

As indicated above, the images and other screen information are recognized by carrying out comparisons of images from the BMS screen(s) (e.g., 400) with images in the HVAC system database. Thus, the HVAC system database with images, line drawings or other representations may be created prior to carrying any image recognition operations in the OLAAM system. In one embodiment, forming the HVAC system database including collecting and storing images, line drawings or other representations of various equipment associated with HVAC systems. Example images/line drawings of different types of HVAC equipment are shown in FIGS. 5-9. FIG. 5 shows images/line drawings of a group of water-cooled chillers of various types, which are denoted by reference labels 500A-500D. FIG. 6 shows images/line drawings of a group of air-cooled chillers of various types, which are denoted by reference labels 600A-600D. FIG. 7 shows images/line drawings of pumps of various types, which are denoted by reference labels 700A-700D. FIG. 8 shows images/line drawings of cooling towers of various types, which are denoted by reference labels 800A-800C. FIG. 9 shows images/line drawings of air handling units 900A-900C and a VAV box 900D. It should be noted that the images of HVAC equipment shown in FIGS. 5-9 are only examples, and any suitable number of images/line drawings may be included. Also, the number of such images/line drawings may grow over time to include new types of HVAC equipment. As indicated above, in addition to, or instead of, images/line drawings any other suitable representations of the HVAC equipment may stored in the HVAC system database to help carry out image recognition.

In addition to the images of the HVAC equipment, language (e.g., English and/or any other languages) alphabets of different styles may be stored in the HVAC system database. Additionally, images of numbers (e.g., 0, 1, 2, 3, 4, 5, 6, 7, 8, and 9), symbols (e.g., Δ, *, #, %, +, °, etc.), images of various shapes (e.g., rectangle, square, circles, lines, arrows, etc.), and images of other miscellaneous items associated with HVAC systems may be stored in the HVAC system database. A detailed embodiment that employs an HVAC system database of the type shown in FIGS. 5-9 for image recognition are related computations is described below in connection with FIGS. 10A-10C.

Figure 10A:
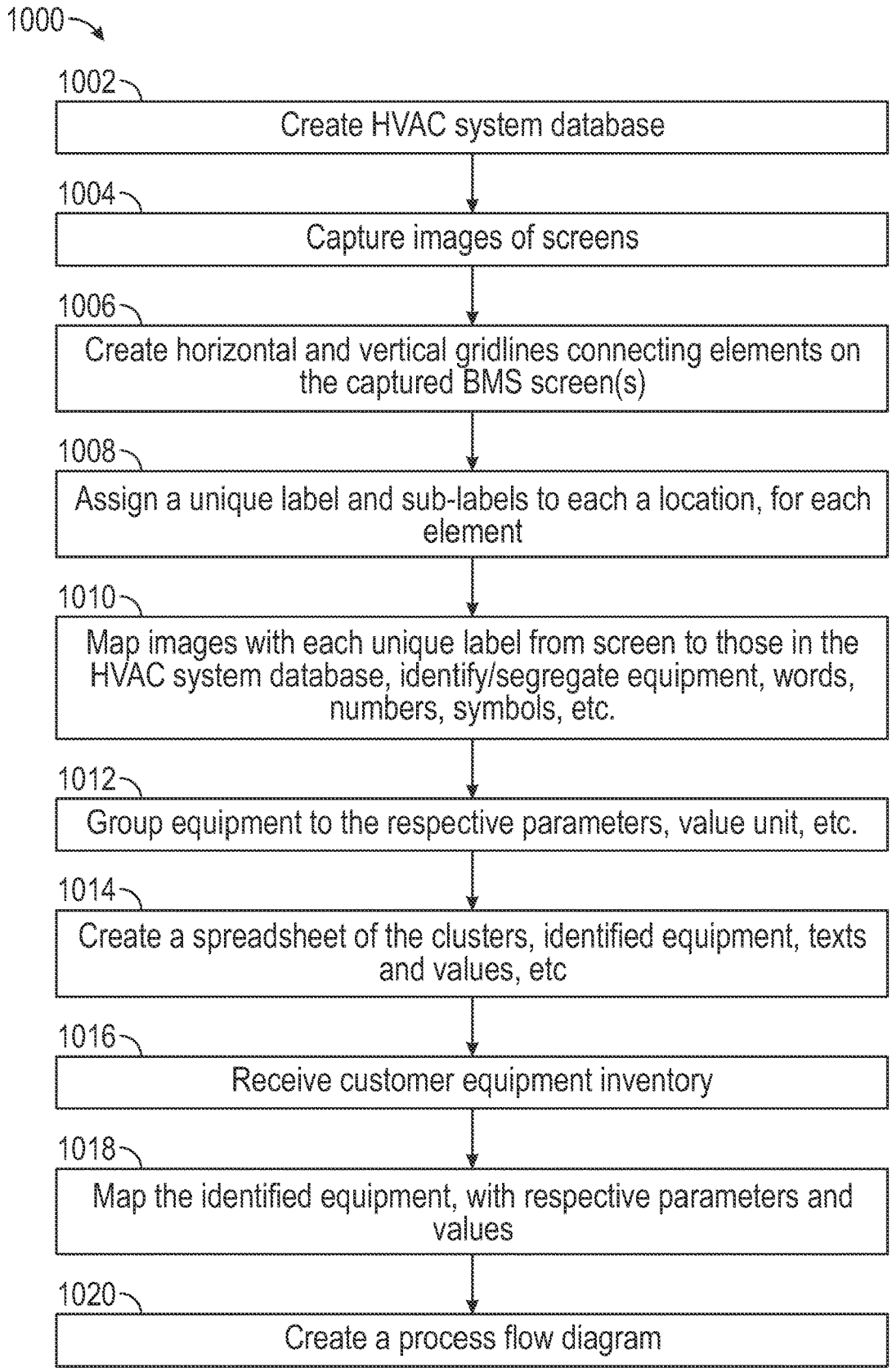
FIG. 10A is a flow chart of a first phase (assessment of potential saving through OLAAM) of a method of obtaining a detailed energy savings estimate and implementing the energy savings in accordance with one embodiment.
Figure 10B:
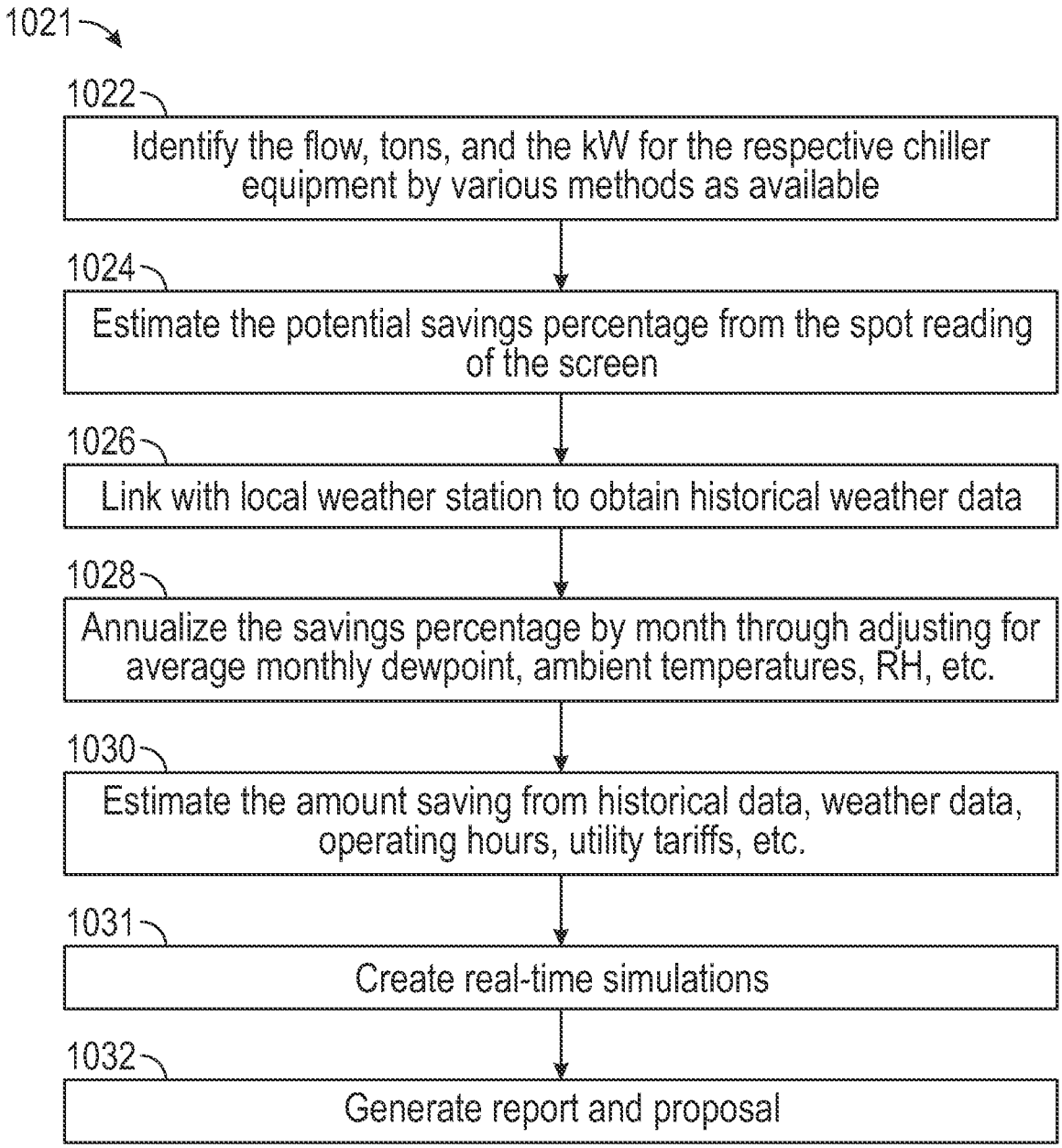
FIG. 10B is a flow chart of a second phase (quantifying and qualifying of the potential savings) of the method of obtaining the detailed energy savings estimate, providing a real-time simulation showing the energy savings, and implementing the energy savings in accordance with one embodiment.
Figure 10C:
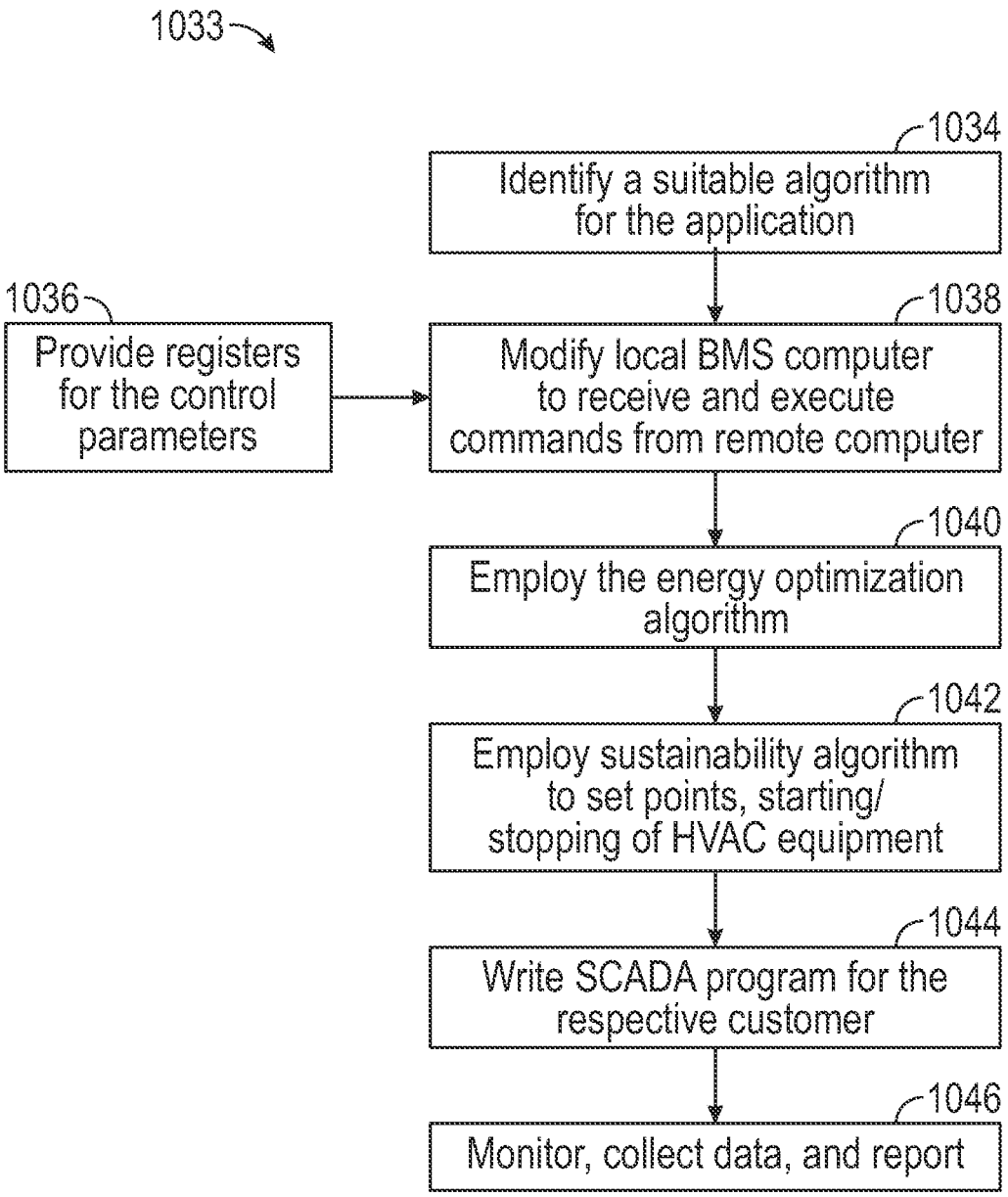
FIG. 10C is a flow chart of a third phase (the actual implementation of the designed algorithms in to the customer computer) of the method of obtaining the detailed energy savings estimate and implementing the energy savings in accordance with one embodiment.
Figure 11A:
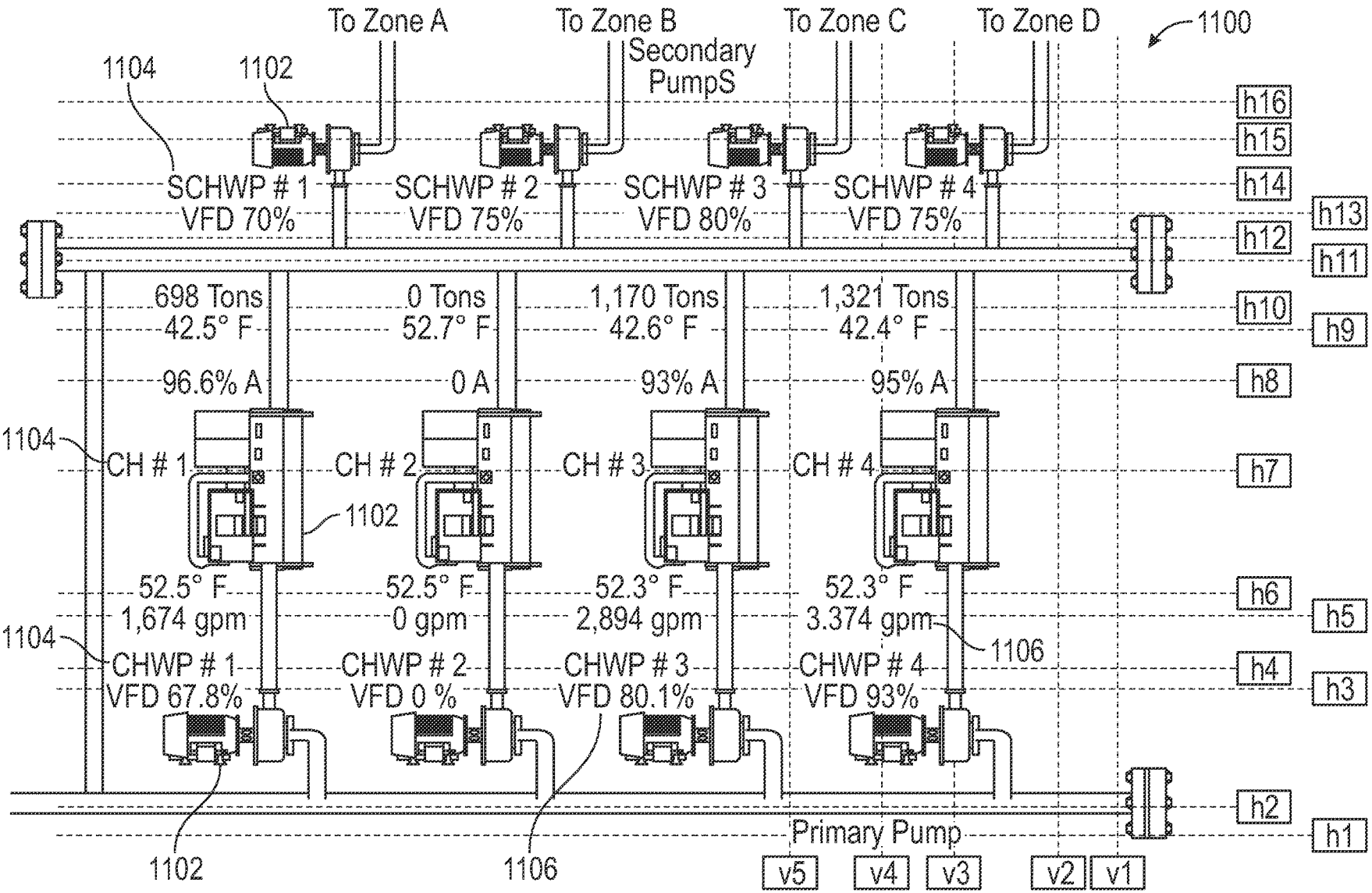
FIG. 11A shows an example BMS screen, which depicts a chiller plant primary system, with horizontal gridlines and vertical gridlines drawn thereon.

FIGS. 10A-10C are flow charts of different stages of operations carried out by the OLAAM system to determine detailed energy savings estimates and to implement the energy savings in accordance with embodiments of the disclosure. FIG. 10A is a flow chart of an assessment stage 1000. The assessment stage 1000 begins at 1002 where a HVAC system database of the OLAAM system stores images or representations of different possible HVAC equipment, alpha numerals, symbols, shapes, units, etc., as described above in connection with FIGS. 5-9. At 1004, an OLAAM system computer captures images of one or more BMS screens that are made available to it as described above in connection with FIG. 4. At 1006, the OLAAM system draws horizontal and vertical gridlines for each captured BMS screen. FIG. 11A shows an example BMS screen 1100, which shows a chiller plant primary system, with horizontal gridlines (e.g., h1-h16) and vertical gridlines (e.g., v1-v5) drawn thereon. Is should be noted that any suitable number of horizontal and vertical gridlines may be drawn in different embodiments. It should also be noted that FIG. 11A may be one of a plurality of screens captured by the OLAAM system, and other captured screens may include a BMS main screen, a chiller plant, a primary chilled water circuit screen, secondary chilled water circuit screen, a cooling tower system screen, a condenser water circuit screen, a chiller by itself screen, etc. Screen 1100 includes images of HVAC equipment, which are denoted by reference numeral 1102, identifiers for the HVAC equipment such as Ch #1-Ch #4 for chillers, CHWP #1-CHWP #4 for primary chilled water pumps, and SCHWP #1-SCHWP #4 secondary chilled water pumps. The identifiers are denoted by reference numeral 1104. The chillers, primary chilled water pumps and secondary chilled water pumps are interconnected by pipes. Screen 1100 further includes operating parameters, units, etc., for the HVAC equipment. The various operating parameters, units, etc., are denoted by reference numeral 1106. As can be seen in FIG. 11A, each horizontal gridline h1, h2, etc., connects any equipment (e.g., Ch #1-Ch #4), parameters, units, values, etc., in its path. A right-bottom portion of screen 1100 (labeled 1150) is shown in FIG. 11B, which is described below in connection with 1008 of flow chart 1000 of FIG. 10A.

Figure 11B:
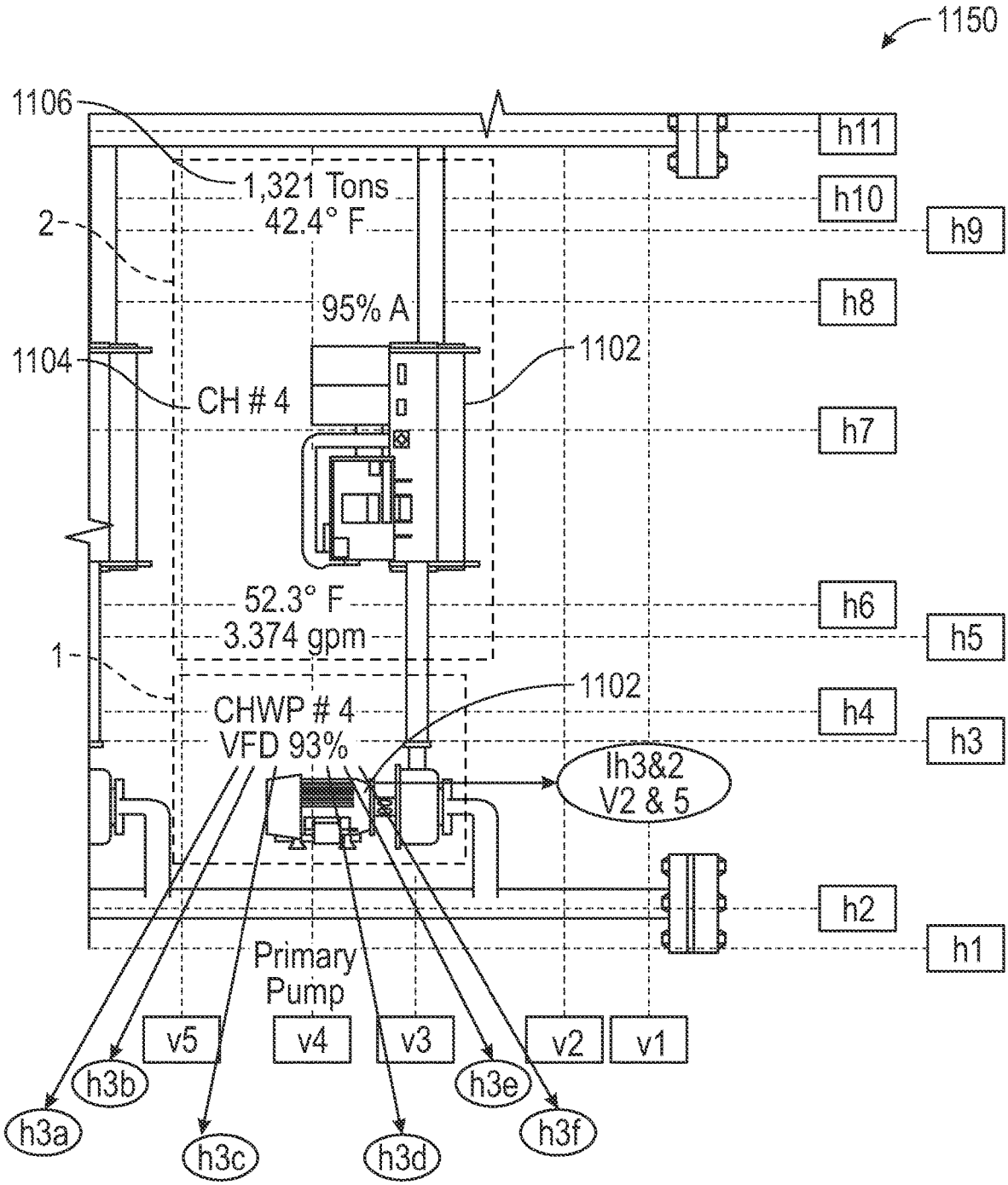
FIG. 11B shows a right-bottom portion of the BMS screen shown in FIG. 11A.

Referring now to 1008 of FIG. 10A and to FIG. 11B, the OLAAM system provides a unique label for each image, alphabet, number, symbol, etc., in the horizontal gridlines h starting from the first (e.g., bottom-most) horizontal line h1. In the interest of simplification, a unique labeling example is shown only for horizontal gridline h3. As can be seen in FIG. 11B, a cluster of alphabets, numbers, etc., that h3 passes through is labeled from left to right as h3a-h3f. As mentioned previously, the process of numbering from the first horizontal line identified as h1 from right to left and from the bottom going upwards continues in all the lines h1, h2, h3, etc., until the left-most image of the top-most horizontal line (e.g., h16 in FIG. 11A) is covered. Labeling of image CHWP #4 is also shown as example in FIG. 11B. Here, the OLAAM system identifies an image between horizontal gridlines h2 and h3, and vertical gridlines v2 and v5. The identified image is labeled as Ih3&2V2&5, where "I" represents "image." Other images of screen 1100 are labeled in similar manner. The OLAAM may similarly draw horizontal and vertical gridlines on other BMS screens (e.g., cooling tower system screen 1180 of FIG. 11C) and apply similar labeling to elements on those screens.

Figure 11C:
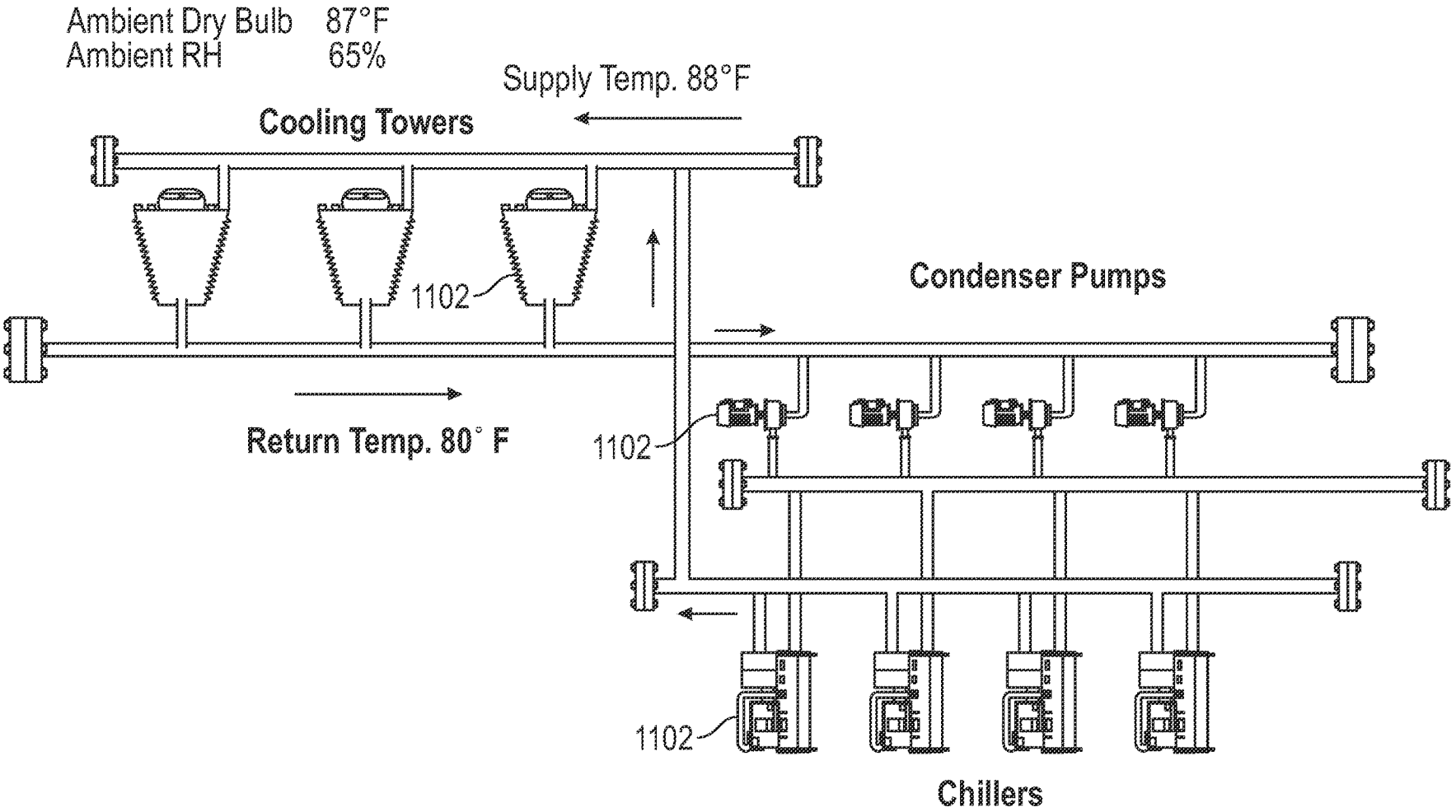
FIG. 11C shows an example BMS screen, which depicts a condenser water circuit with a cooling tower system.

At 1010 of FIG. 10A, the OLAAM system maps the elements/images with each unique label from, for example, screens 1100 of FIG. 11A and 1180 of FIG. 11C to alphabets, symbols, numbers, equipment images, etc., stored in the HVAC system database, and identifies/segregates equipment, words, numbers, symbols, etc. Examples of images in the HVAC system database are in above-described FIG. 5-9.

At 1012, the equipment, parameters, values, etc., are grouped. The grouping is driven by proximity of the numbers/labels associated with the equipment. Thus, when the images of the equipment and parameters are recognized and identified, a spreadsheet is created with associating each equipment/pipeline/instrument etc., with appropriate parameters, values, units, symbols, horizontal and vertical coordinates. A sample of such grouping is shown below in Table 3.

TABLE 3

| Group/ | Grouping | | | | | | |
|---|---|---|---|---|---|---|---|
| Cluster # | Parameter | Associated Equipment | possible units | | | | |
| 1 | Flow | Chillers, pumps, Headers, AHUs, etc. | gpm | l/s | M3/Hour | M3/min | CFM |
| 2 | Temperature | chillers, headers, AHUs, etc. | ° F. | ° C. | deg F. | deg C. | |
| 3 | Cooling load | Chillers, AHUs, etc. | Tons | kW | Btu hour | | |

At 1014, the group is identified as a whole. For example, in FIG. 11B, line h3 and group/cluster 1 includes 3 alphabets separated by a space, two numbers, and a symbol. The alphabets are combined as VFD (variable frequency drive), and the numbers and the symbol are combined as "93%" which is identified as a percentage of the VFD. Group 1 is thus identified as VFD 93% of the drive, and recorded in a spreadsheet shown below in Table 4. In the grid portion between h3 and h2 and v2 and v5, the image of the equipment is identified as a pump based on comparisons with images in the HVAC system database. In line h4, group 1 is identified as CHWP #4. All the identified images fall in the vertical plane between v2 and v5 in the order from top as "CHWP #4, followed below "VFD 93%", followed by the image of a pump. The OLAAM system identifies thus: Chilled Water Pump #4 as denoted by CHWP #4, is fitted with a Variable frequency Drive as denoted by VFD at 93% of the speed and place the three in the grid h2, h4 and v2, v5 forming the first group in the recreated process diagram shown in FIG. 12, accordingly recorded in the spreadsheet shown in Table 4.

TABLE 4

| Horizontal/ Vertical | Group/ | List of Identified Images | | | | | | | | | |
|---|---|---|---|---|---|---|---|---|---|---|---|
| | | alphabets, numbers, symbols, etc. | | | | | | | | | |
| line # | Cluster # | a | b | c | d | e | f | Others | Identified as | Value | Unit |
| h3 | 1 | V | F | D | 9 | 3 | % | | VFD | 93 | % |
| h3&h2 andv2&v5 | 1 | | Image | | | | | equipment | Pump | NA | NA |
| h4 | 3 | C | H | W | P | # | 4 | | Chilled water pump # 4 | NA | NA |

It should be noted that group 1 is one of multiple groups that screen 1100 of FIG. 11A is divided into for image recognition. The group identification described above in connection with 1014 is carried out on each of the different groups (e.g., group 2 shown in FIG. 11B, etc.) until all equipment images, parameters, units, numbers, etc., on the screen(s) are recognized.

At 1016, customer equipment inventory is received by the OLAAM system. In addition to providing access to the OLAAM screens, the customer may also provide the OLAAM system with an inventory list. An example inventory list that may be provided by the customer is included below in Table 5.

TABLE 5

| Chiller plant basic inventory | | | | | | | | | | | |
|---|---|---|---|---|---|---|---|---|---|---|---|
| | | Chiller Design | | Chilled water pump Design | | Condenser water pump Design | | Chilled water secondary pump Design | | Cooling Towers | |
| Chiller # | Make | Capacity Tons | Full Load, kW | GPM | Full Load, kW | GPM | Full Load, kW | GPM | Full Load, kW | Cell # | Fan kW |
| 1 | York | 1,000 | 600 | 2,400 | 25 | 3,000 | 31 | 4,800 | 75 | 1 A | 44 |
| 2 | York | 1,500 | 900 | 3,600 | 38 | 4,500 | 47 | 7,200 | 75 | 1 B | 44 |
| 3 | York | 1,500 | 900 | 3,600 | 38 | 4,500 | 47 | 7,200 | 75 | 2 A | 44 |
| 4 | York | 1,500 | 900 | 3,600 | 38 | 4,500 | 47 | 7,200 | 75 | 2 B | 44 |
| | | | | | | | | | | 3 A | 44 |
| | | | | | | | | | | 3 B | 44 |

At 1018, the equipment in the BMS screens is mapped based on the vertical and horizontal coordinates of the gridlines to make logical sense of the chilled water system. For example, the chiller equipment and the main primary supply header are associated with flows. Per logical sense, header flow will always be greater than the chiller flow. Using this technique, Table 6 shown below is created.

TABLE 6

| Mapping | | | | | | | | | | |
|---|---|---|---|---|---|---|---|---|---|---|
| Group | Grids | Item | Flow GPM | CHWET ° F. | CHWLT ° F. | % Amps | Evaporator Delta P, psig | Condenser Delta P, psig | Supply Temp ° F. | Return Temp ° F. |
| 15 | h5&v6, v7 | Chiller #1<br>Chiller #2<br>Chiller #3<br>Chiller #4 | 3000 | 52.4 | 46.5 | 90% | | | | |
| 1 | h1&v3, v4 | Primary supply header<br>Primary return header | 8200 | | | | | | | 52.3 |

Figure 12:
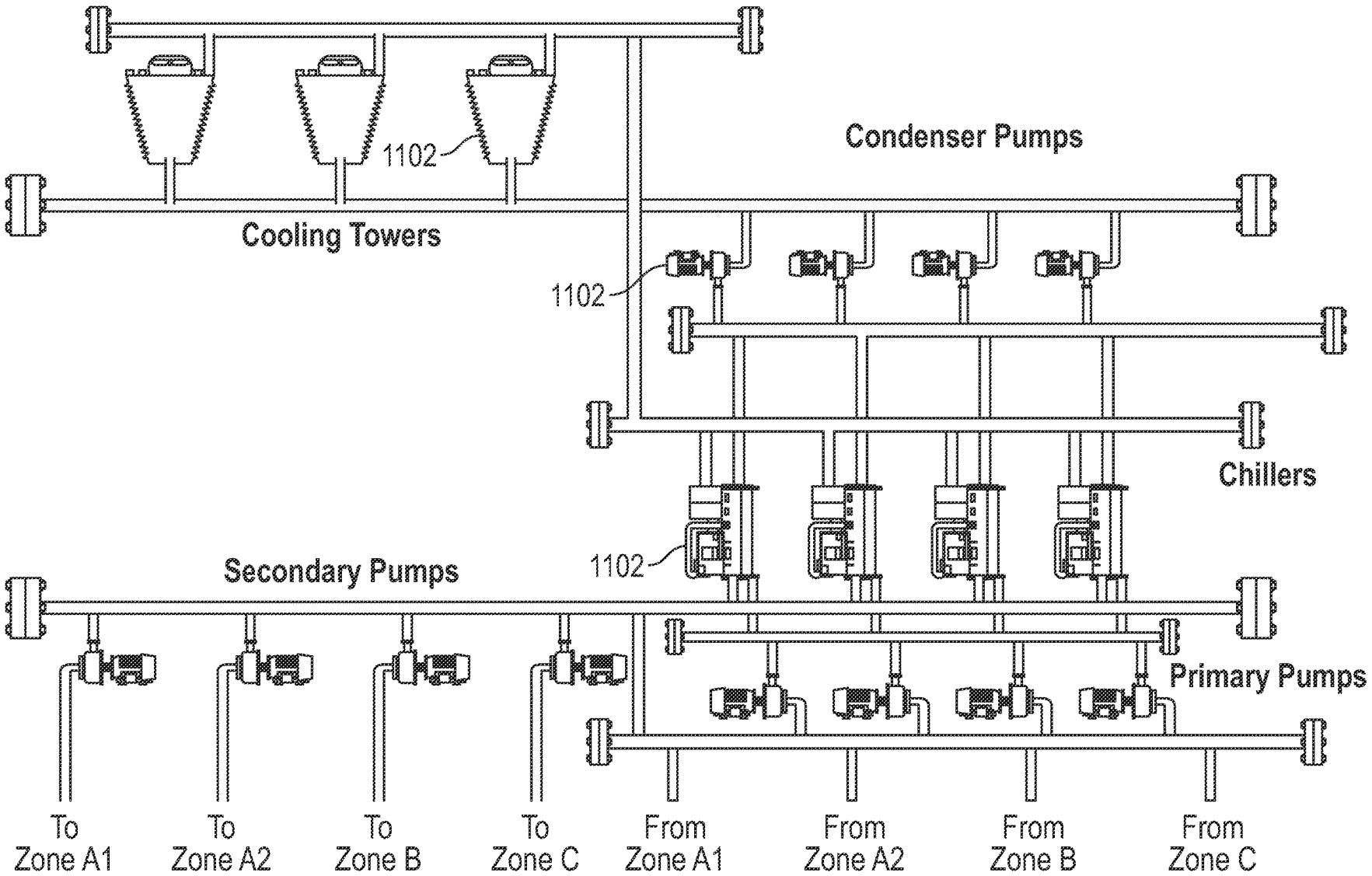
FIG. 12 illustrates a chilled water process flow diagram.

At 1020, the identified equipment, parameters, and logical sequence are employed by the OLAAM system to create a chilled water process flow diagram. Form the images in the example screens shown in FIGS. 11A and 11C and through the above-described procedures, the OLAAM system determines the chiller plant configuration is one of "Constant Primary and Variable Secondary" as schematically represented in FIG. 12. In other words, the OLAAM system analyzes individual screens (e.g., 1100 of FIG. 11A and 1180 of FIG. 11C) of the BMS system, and combines information from the different screens to determine a process flow in the BMS system (e.g., the chilled water process flow diagram shown in FIG. 12).

The assessment phase described above in connection with FIG. 10A, which includes image recognition, significantly reduces human interaction and time for energy optimization projects. The assessment phase is followed by an analysis phase that is described below in connection with FIG. 10B, which is a flow chart 1021 of the analysis stage.

Figure 13A:
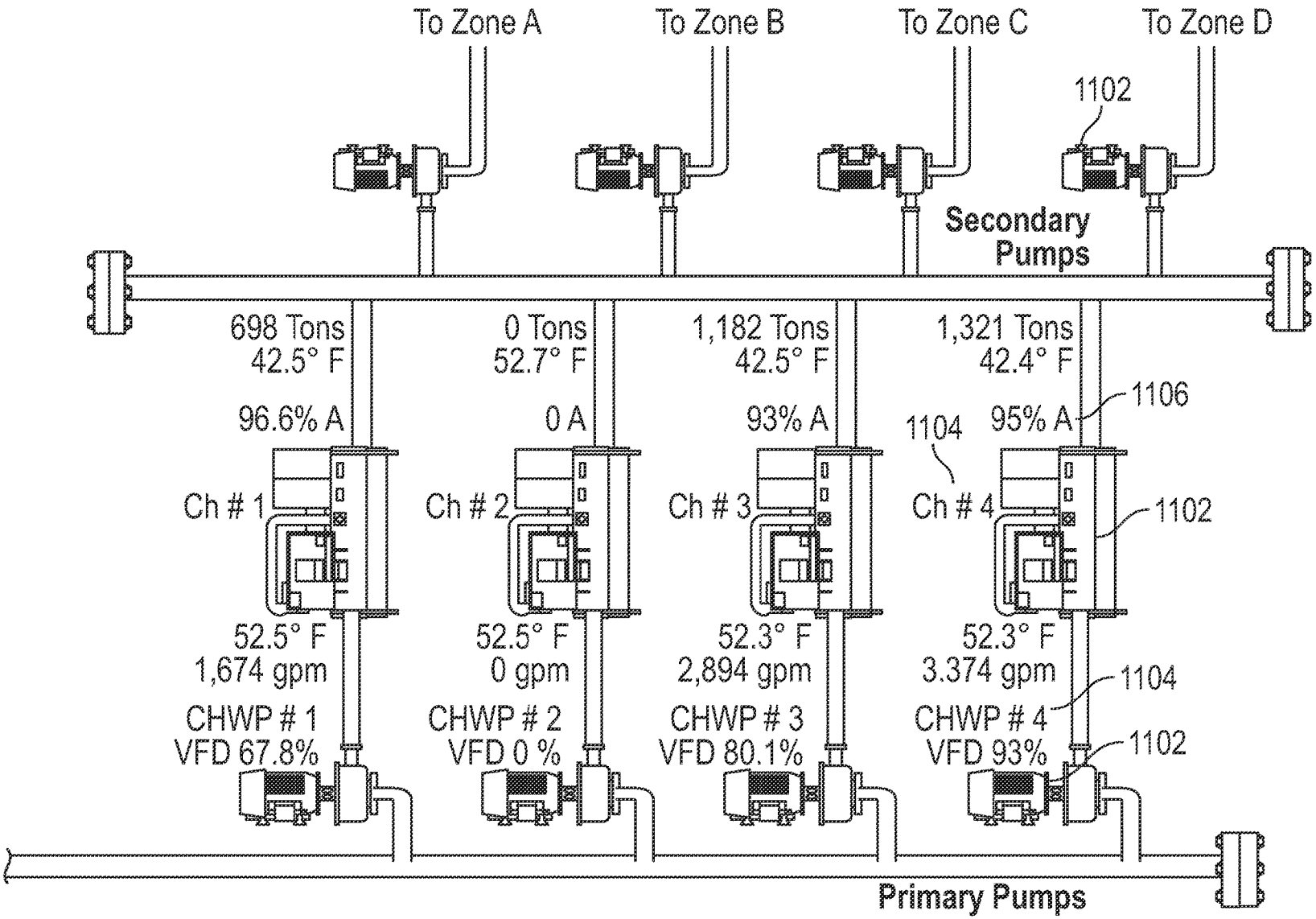
FIG. 13A illustrates a first example of a BMS screen image in which flow, tons, and kilowatt (kW) readings are available.
Figure 13B:
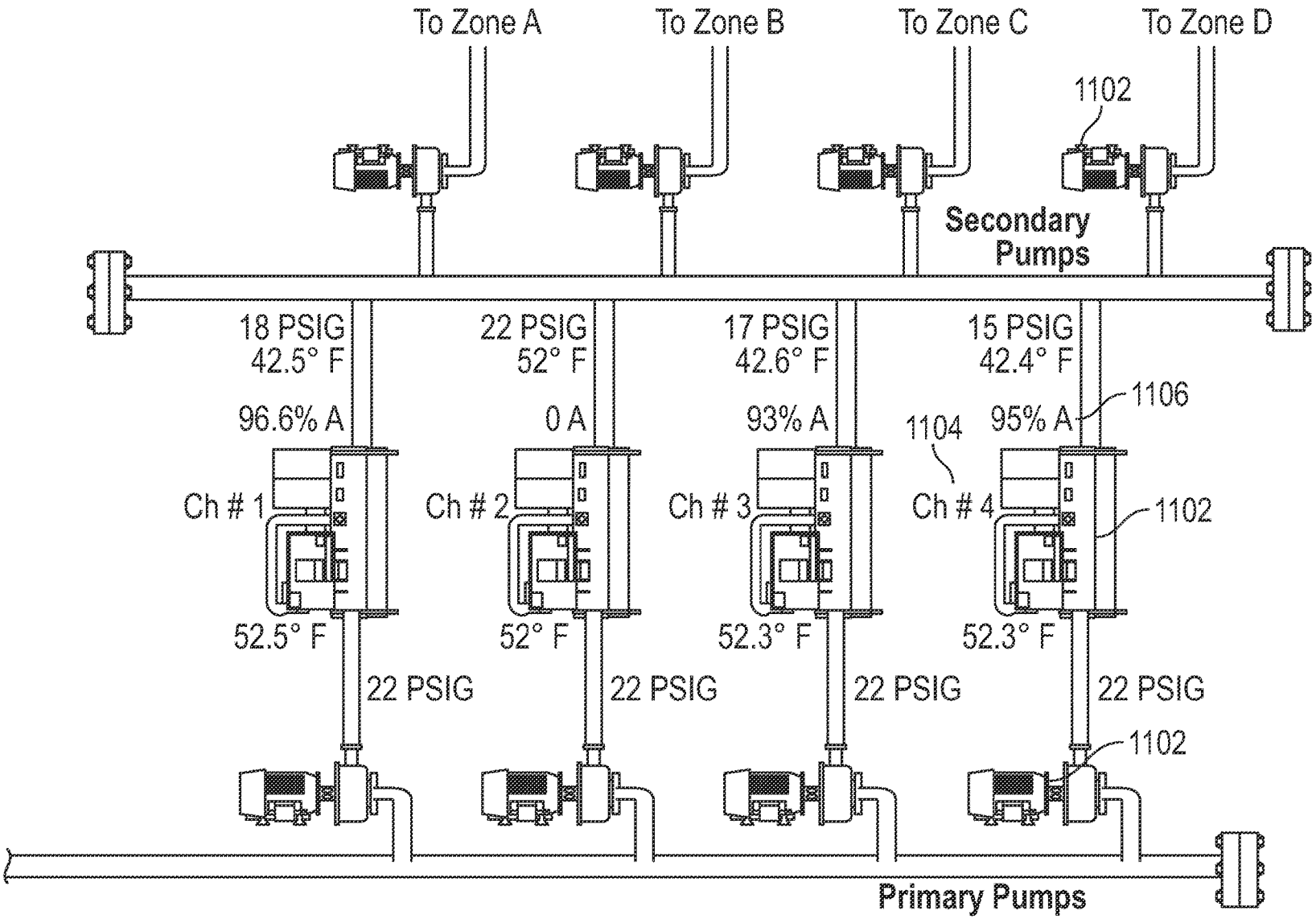
FIG. 13B illustrates a second example of a BMS screen image in which pressure drop (AP), kW and temperature difference (AT) readings are available.
Figure 13C:
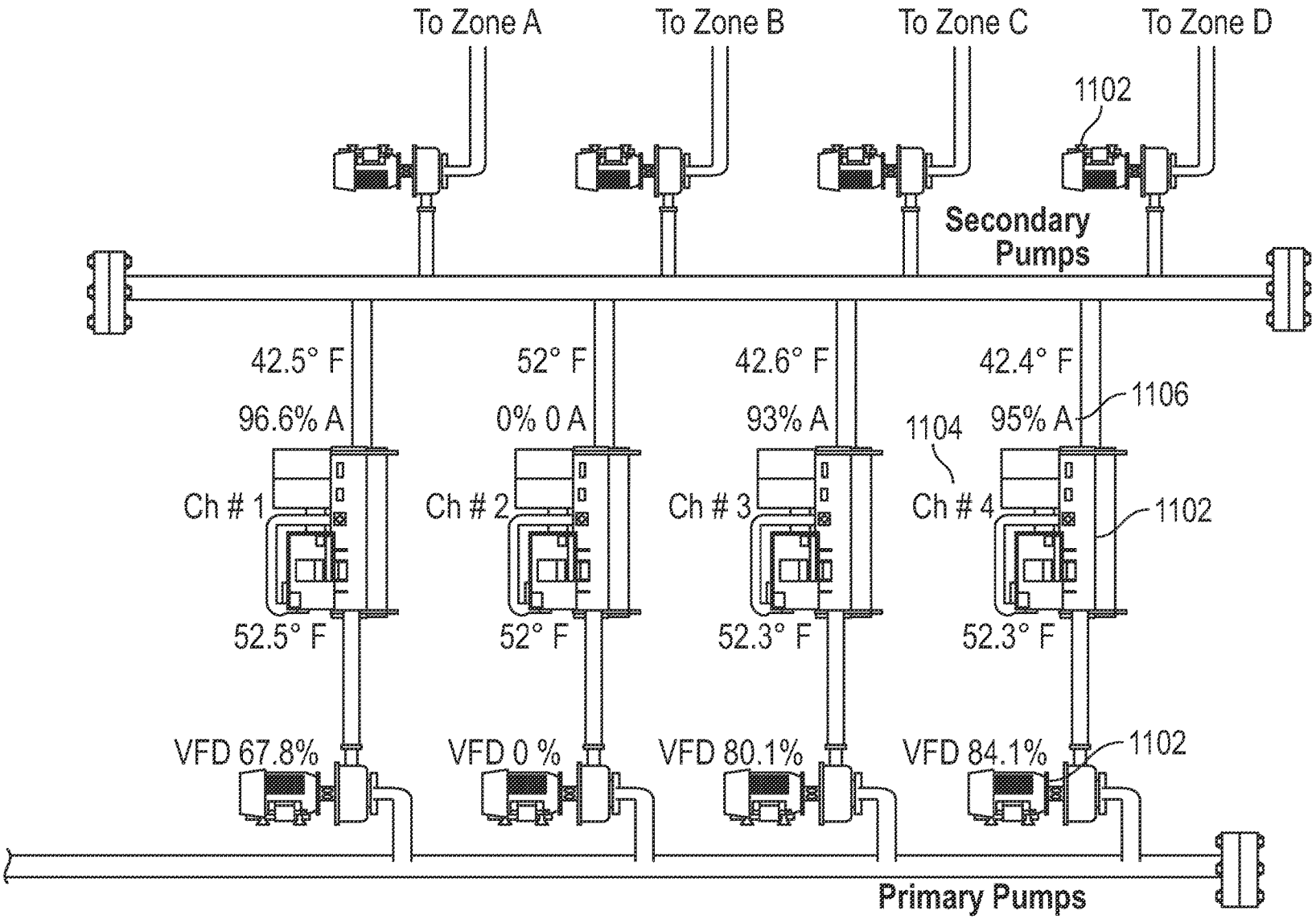
FIG. 13C illustrates a third example of a BMS screen image in which kW, chilled water pump's speed percent, and AT readings are available.

In order for optimization of energy consumption for the future, the current energy efficiency (base line) in terms of "kW/Ton" for cooling, British Thermal Unit (BTU)/floor space for heating, and kW/building volume for ventilation should first be determined. Examples in FIGS. 13A-13C are considered for determining the (total) baseline kW/Ton and how to improve the kW/Ton to the design/benchmark kW/Ton or better in a cost and time effective manner. Each of FIGS. 13A, 13B and 13C includes the same HVAC elements as FIG. 11A connected together in a connection configuration as FIG. 11A. However, as will be described below, determination of the baseline kW/Ton efficiency involves different approaches for FIGS. 13A, 13B and 13C due to differences in available information on those screens.

From the inventory list in Table 5 above and from the process diagrams (e.g., the chilled water process flow diagram shown in FIG. 12), for this example, the OLAAM system determines the following: 1) four chillers (CH1, CH2, CH3, and CH4), with respective chilled water pumps fitted with VSDs (CHWP1, CHWP2, CHWP3, and CHWP4), 2) four secondary pumps fitted with VSDs (SCHWP1, SCHWP2, SCHWP3, and SCHWP4), 3) four condenser water pumps fitted with VSDs (CWP1, CWP2, CWP3, and CWP4), and three cooling towers CT1, CT2, CT3 and each with two cells A and B. Each cell is fitted with one fan each with a VSD.

Referring now to 1022 of FIG. 10B and to FIGS. 13A-13C, the OLAAM system identifies the flow, Tons, and the kW for the respective chiller equipment by various methods as available. Two factors are needed to identify the kW/Ton efficiency and subsequently the potential for optimization. While kW or % of electrical load may be typically available from a chiller display or the BMS, the Tons may not be displayed in majority of the chiller displays or BMS screens. Where the Ton display is not available, the OLAAM system tries to estimate the Ton accurately or reasonably accurately by one of the following methodologies:

1. Tons from Temperature Difference (ΔT)

The OLAAM system determines the tons when the primary chilled water pump is running at full speed, and the temperature difference between leaving chilled water temperature (LWT) minus the entry chilled water temperature (EWT) is known (e.g., obtained from FIG. 13C):

$$\text{Spot Tons}=\text{spot } \Delta T/\text{design } \Delta T*\text{Design full load Tons} \qquad \text{Equation 1}$$

Substituting values from the screen of FIG. 13C into Equation 1 yields a Spot Tons value of about 3,175 Tons.

2. Tons from Pressure Difference Δp

The OLAAM system will determine the flow from pressure drop (Δp) across the evaporator water flow (e.g., from FIG. 13B). Tons can be calculated from the flow as follows:

$$\text{Spot Tons}=(\sqrt{(\text{spot } \Delta p/\text{design } \Delta p)}*\text{Design full load flow}*\text{spot } \Delta T \text{ in } ^\circ\text{ F.})/24 \qquad \text{Equation 2}$$

Substituting values from the screen of FIG. 13B into Equation 2 yields a Spot Tons value of 3,170 Tons.

3. Tons from Flow

Tons from flow in gallons per minute (GPM) may be determined as follows:

$$\text{Spot Tons}=(\text{Spot flow in GPM}*\text{spot } \Delta T \text{ in } ^\circ\text{ F.})/24 \qquad \text{Equation 3}$$

Substituting values from the screen 13A into Equation 3 yields a Spot Tons value of 3,170 Tons.

4. Tons from Direct Reading $$\text{Spot Tons}=\text{Spot Readings} \qquad \text{Equation 4}$$

In FIG. 13A, the "tons" reading is directly provided from the process diagrams. The instant readings are noted and recorded in a spreadsheet shown in Table 7 below to assess instant optimization potential.

TABLE 7

| Spot reading of primary chiller plant | | | | | |
|---|---|---|---|---|---|
| Chiller # | Tons | % kW | GPM | EWT | LWT |
| 1 | 698 | 96.60% | 1,674 | 52.50 | 42.50 |
| 2 | | | 0 | — | — |
| 3 | 1170 | 93.00% | 2,894 | 52.30 | 42.60 |
| 4 | 1336 | 95.00% | 3,374 | 51.90 | 42.40 |

Referring to 1024 of FIG. 10B, a potential savings percentage is estimated from the spot reading on the screen. Chillers run at maximum kW/Ton (lowest efficiency) at full load. Typically, chillers do not run at full load all the time. In fact, they normally run at full load probably 10% of the time. Also, full load kW/Ton is determined at the design condenser water entry temperature. In reality, and especially in the areas where the weather conditions vary time to time and place to place, the condenser water temperature even in an uncontrolled system will always tend to be lower than the design temperature. At lower temperatures combined with part loads the chillers function better with reference to the energy. Comparison of part load kW/Ton to full load kW/ton is a very conservative way of estimating the potential. Table 8 below shows a potential saving % in the primary chilled water plant.

TABLE 8

| Spot opportunity identification-chillers | | | | | | | | | |
|---|---|---|---|---|---|---|---|---|---|
| Chiller # | full load Tons | full load kW | Current Tons | Current load % | current % kW | current kW | full load kW/ Ton | current kW/ ton | % improvement |
| 1 | 1,000 | 600 | 698 | 70% | 96.6% | 579.60 | 0.60 | 0.83 | 38% |
| 2 | | | | | | | | | |
| 3 | 1,500 | 900 | 1,170 | 78% | 93.0% | 837.00 | 0.60 | 0.72 | 19% |
| 4 | 1,500 | 900 | 1,321 | 88% | 95.0% | 855.00 | 0.60 | 0.65 | 8% |
| Overall | 4,000 | 2,400 | 3,189 | | | 2,272 | 0.60 | 0.71 | 19% |

Further improvement in kW/ton may be obtained. Chiller manufacturers conduct performance tests per Air-Conditioning Heating Refrigeration Institute (AHRI) (formerly known as ARI) part loads performance tests of chillers, and AHRI certifies the performance test accordingly. One such certification program is AHRI part load performances test where part load conditions are simulated for chillers at various condenser water entry temperatures. Manufacturers should submit the AHRI part load performance tests' certificate to the customer. Table 9 below is a performance certificate for the chillers under discussion.

TABLE 9

| York Chillers-ARI Part Load Performance | | | | | | | | | |
|---|---|---|---|---|---|---|---|---|---|
| % Capacity | Tons | Power kW | CHWET ° F. | CHWLT ° F. | CHW Flow, USGPM | CW Flow, USGPM | CWET ° F. | CWLT ° F. | Chiller kW/ Ton |
| 100% | 1,500 | 900 | 52 | 44 | 3,600 | 4,500 | 85 | 92 | 0.60 |
| 90% | 1,350 | 743 | 51 | 44 | 3,600 | 4,500 | 81 | 87 | 0.55 |
| 80% | 775 | 409 | 50 | 44 | 3,600 | 4,500 | 77 | 83 | 0.53 |
| 70% | 678 | 281 | 50 | 44 | 3,600 | 4,500 | 73 | 78 | 0.40 |
| 60% | S81 | 216 | 49 | 44 | 3,600 | 4,500 | 69 | 73 | 0.31 |
| 50% | 484 | 154 | 48 | 44 | 3,600 | 4,500 | 65 | 69 | 0.32 |
| 40% | 388 | 155 | 47 | 44 | 3,600 | 4,500 | 65 | 68 | 0.40 |
| CHW | Chilled Water | | | | | | | | |
| CW | Condenser Water | | | | | | | | |
| CHWET ° F. | Chilled Water Entry Temperature ° F. | | | | | | | | |
| CHWLT ° F. | Chilled Water Leaving Temperature ° F. | | | | | | | | |
| CWET ° F. | Condenser Water Entry Temperature ° F. | | | | | | | | |
| CWLT ° F. | Condenser Water Leavin2 Temperature ° F. | | | | | | | | |

In the above example in Table 9, the currently available Condenser Water Entry Temperature (CWET) is 81° F. If the conditions are maintained per AHRI performance certificate and the chiller is loaded at 90%, the kW/Ton efficiency of the chillers are bound to improve further up to 29% from initially identified 19%. However, this 29% improvement is only on chillers. The OLAAM system determines the spot saving from the chillers as follows:

Spot Tons of cooling: 3,247 Tons
Spot kW of chillers: 2,272 kW
Improved kW with OLAAM platform: 1,613 kW
Chiller savings in kW: 659 kW
Chiller savings in kW/Ton: 0.16 kW/ton
Increase in pump kW/Ton: 0.024 kW/Ton
Net savings in kW/Ton: 0.136 kW/Ton Annualized energy saving depends on annualized cooling load which in turn depends on weather conditions, fresh air intake (air changes), and building types. While the weather conditions in a particular ZIP code will be identical for almost all types of buildings, the fresh air intake and the user comfort and/or process condition required will vary depending on the type of building.

Weather conditions influence the amount moisture vapor that condenses at the AHU, which in turn influences the number of chiller equipment to be run, and the temperature of the leaving water from the chiller. Accordingly, at 1026 of FIG. 10B, the OLAAM system is linked with a weather station (local to the building of interest) to obtain historical weather data. At 1028, the energy savings percentage is annualized by month through adjusting for average dew-point, ambient temperature, relative humidity, etc.

Additional factors that may be taken into consideration for the energy savings percentage calculations include fresh air intake and building type. Federal, state, and local statutory mandates specify the number of air changes based on the type of building. ASHRAE standards are available for different types of buildings, number of occupants, and the usage pattern. Building types (e.g., hospital, hotel, office, datacenter, etc.) will dictate the hours of annual operation.

At 1030, the OLAAM system estimates the amount of savings from historical data, weather data operating hours, utility tariffs, etc. The OLAAM system will include all the above in its adjustment for annualization (e.g., calculation of annualized Ton hours (TRs). If a 100 Ton chiller runs for 1 hour, it generates 100 TRs of cooling. Annualized TRs based on the all the above for the current example and potential monthly savings are projected by the OLAAM system in Table 10 below.

TABLE 10

Estimated guranteeable savings

| Month | Ave.Dry Bulb o F | Ave.Dew Point ° F. | Ave.Ton Hours (TRs) | current kW/Ton | OLAAM kW/Ton | monthly savings, kWh |
|---|---|---|---|---|---|---|
| January | 58 | 50 | 12,07,884 | 0.72 | 0.58 | 1,72,727 |
| February | 72 | 57 | 10,90,992 | 0.72 | 0.58 | 1,56,012 |
| March | 65 | 58 | 24,15,768 | 0.72 | 0.58 | 3,45,455 |
| April | 73 | 61 | 23,37,840 | 0.72 | 0.58 | 3,34,311 |
| Mav | 78 | 68 | 24,15,768 | 0.72 | 0.58 | 3,45,455 |
| June | 82 | 74 | 23,37,840 | 0.72 | 0.58 | 3,34,311 |
| July | 82 | 75 | 24,15,768 | 0.72 | 0.58 | 3,45,455 |
| August | 83 | 75 | 24,15,768 | 0.72 | 0.58 | 3,45,455 |
| September | 83 | 75 | 23,37,840 | 0.72 | 0.58 | 3,34,311 |
| October | 79 | 69 | 24,15,768 | 0.72 | 0.58 | 3,45,455 |
| November | 70 | 62 | 23,37,840 | 0.72 | 0.58 | 3,34,311 |
| December | 66 | 59 | 12,07,884 | 0.72 | 0.58 | 1,72,727 |

Table 11 below shows an energy savings summary calculated by the OLAAM system.

TABLE 11

SAVINGS SUMMARY

| Description | Amount/Year | unit |
|---|---|---|
| kWh savings per year | 3,565,985 | |
| Average energy cost | $0.11 | /kWh |
| Annual Savings | $392258 | /year |

Figure 14:
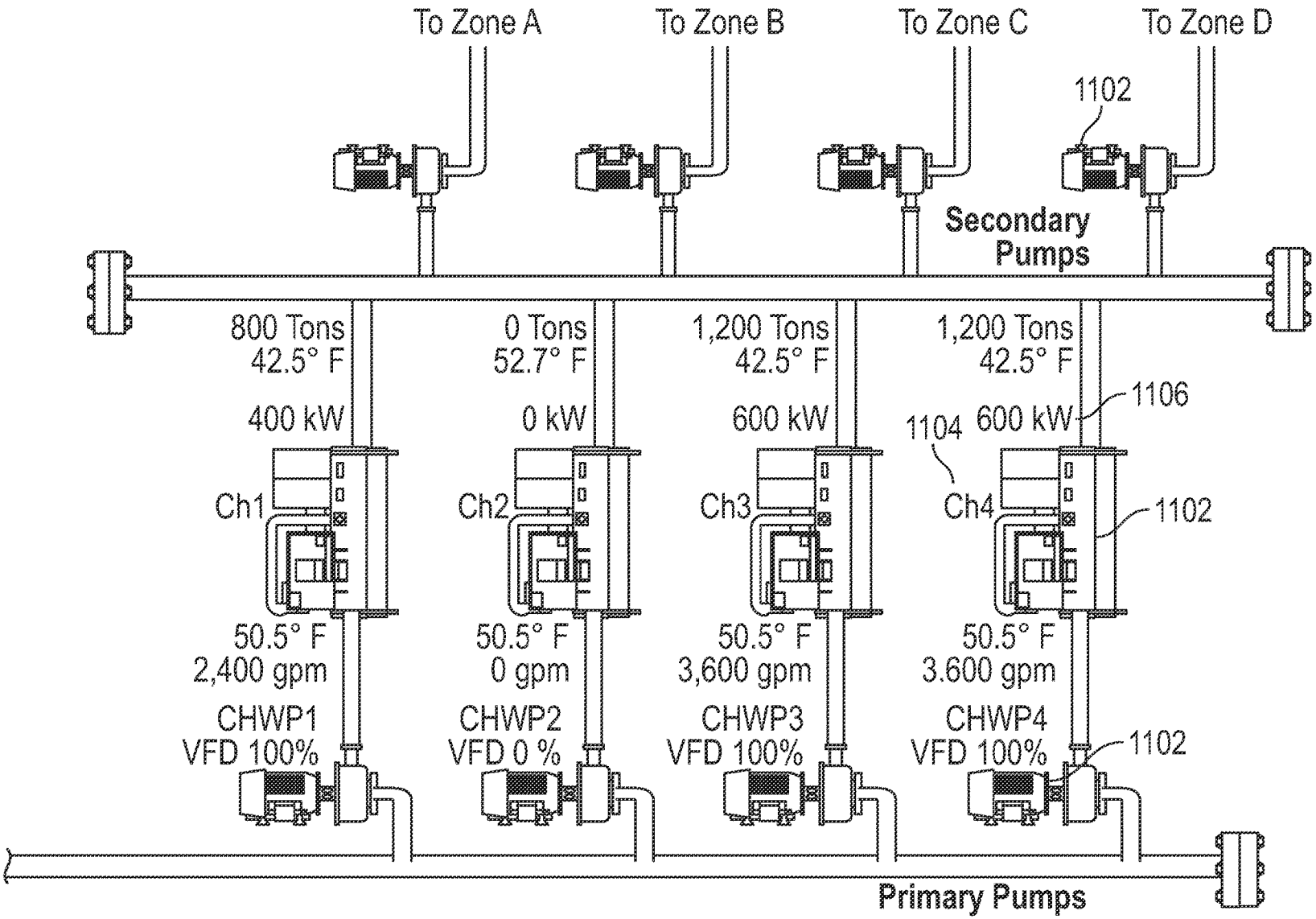
FIG. 14 illustrates an example of a screen depicting a real-time simulation showing energy savings determined by the OLAAM system.

With the customer equipment inventory (e.g., Table 5 above), the real time weather data obtainable from OLAAM (item 1026 FIG. 10B), the utility data obtainable from OLAAM (item 106 from FIG. 1), and the operational algorithms created by the OLAAM program, a real-time simulation is generated by the OLAAM program at 1031. An example of a real-time simulation is shown in FIG. 14. The simulation may also be compared with the current real-time actual consumption shown in FIG. 13A (e.g., screens 13A and 14 may be shown side-by-side on a display or monitor). In some embodiments, the simulation may be made available to the customer upon request. Thus, as can be seen in FIGS. 13A and 14, the real-time simulation will demonstrate to the customer the energy consumption by the OLAAM program for comparison with the current real-time actual consumption. In general, the simulation can run for any suitable length of time. In some embodiments, the simulation can run for a minimum of one day to a maximum of three months dependent on the licensing arrangements with the customer. It should be noted that the running of the simulation is optional, and therefore need not be provided in all embodiments.

The purpose of the simulation is to enhance the confidence level of the customer of the OLAAM program with no interference to the current operation and with zero or practically no or negligible effort from the staff.

The chiller plant efficiency depends on the ambient weather conditions such as the 1) dry bulb temperature, 2) Relative Humidity (RH %) and 3) the dew point temperature.

Table 12 and FIG. 13A are representations of the current operations. Table 13 and FIG. 14 are representations of the OLAAM simulated operation.

TABLE 12

| Chiller plant current operation @ 11;30 AM | | | | | | | |
|---|---|---|---|---|---|---|---|
| | | Chiller | | Chilled water pump | | | |
| Chiller # | Make | Capacity, Tons | Power , kW | GPM | Power, kW | EWT ° F. | LWT ° F. |
| 1 | York | 697.5 | 580.0 | 1,674.0 | 8.5 | 52.5 | 42.5 |
| 2 | York | — | — | — | — | | |
| 3 | York | 1,181.7 | 837.0 | 2,894.0 | 19.6 | 52.3 | 42.5 |
| 4 | York | 1,321.5 | 855.0 | 3,374.0 | 31.0 | 51.9 | 42.5 |
| Cooling output | | | | | | 3,201 | Tons |
| Chiller + Chilled water pump kW | | | | | | 2,331 | kW |
| kW/Ton at the chiller plant | | | | | | 0.73 | |

TABLE 13

| Chiller plant current operation @ 11;30 AM simulated via cloud | | | | | | | |
|---|---|---|---|---|---|---|---|
| | | Chiller | | Chilled water pump | | | |
| Chiller # | Make | Capacity, Tons | Power, kW | GPM | Power, kW | EWT ° F. | LWT ° F. |
| 1 | York | 800.0 | 400.0 | 2,400.0 | 25.0 | 50.5 | 42.5 |
| 2 | York | — | — | — | — | | |
| 3 | York | 1,200.0 | 600.0 | 2,400.0 | 38.0 | 50.5 | 42.5 |
| 4 | York | 1,200.0 | 600.0 | 2,400.0 | 38.0 | 50.5 | 42.5 |
| Cooling output | | | | | | 3,200 | Tons |
| Chiller + Chilled water pump kW | | | | | | 1,701 | kW |
| kW/Ton at the chiller plant | | | | | | 0.53 | |

The improvement is in table 14 below:

TABLE 14

| | | |
|---|---|---|
| Improvement in effciency | | 27% |
| Savings in kW | 628.27 | kW |

The customer will observe from the screen shown in FIG. 13A that the system needs 3,200 Tons@42.5° F. The total kW consumption for 3,200 Tons in the current operation is 2,331 kW which includes the chillers' kWs and the primary chilled water pumps' kWs. If permitted to view the simulation (FIG. 14), the customer will be able to see for the same tons and at the 42.5° F., the consumption will only be 1,701 kW. The saving of 629 kW or 27% will be observed by the customer.

At 1032, a report and proposal is generated by the OLAAM system. For example, a report and proposal including the following line items may be automatically generated by the OLAAM system at the end of the analysis phase.

i. Executive summary
ii. Opportunities identified
iii. Guaranteed savings
iv. Terms of the letter of intent for the trials
v. Scope of work for the trials
vi. Mapping requirements
vii. Template for a Software as a Service (SaaS) contract
viii. Signature and acceptance page The objective of OLAAM is to identify the energy saving and implement the saving project with the customer's own BMS without any additional hardware in a non-intrusive manner. A facility with a BMS would have in place all the analog and digital inputs for the loading/unloading and/or starting/stopping of the HVAC equipment. It may not have the energy optimization algorithms such as the OLAAM system can provide. Since the OLAAM system will supervise and control only the energy optimization functions of the BMS, it will not interfere the other operational and safety aspects of the HVAC equipment. When the customer accepts and signs report and proposal described above in connection with 1032 of the FIG. 10B, the OLAAM system is employed to implement the energy savings for the customer's facility (e.g., building).

The implementation process will start with a manual trial after issuance of the letter of intent by the customer. This process is commercial and therefore is not described in this disclosure. FIG. 10C is a flow chart 1033 of the implementation process.

Referring now to FIG. 10C, at 1034, the OLAAM system identifies one or more suitable algorithms for implementing the energy savings. After the data analysis and the local weather conditions, the type of building usage, and the available in situ equipment identified, the OLAAM system selects as many algorithms as suited (e.g., two algorithms) for the job under consideration. The two algorithms are as follows:

i. Energy optimization per manufacturer's specifications
ii. Enhancing the sustainability by dew point control.

Energy optimization per manufacturer's specifications is first described below in connection with Tables 15-18. Thereafter, enhancing the sustainability by dewpoint control is described.

HVAC equipment (including but not limited to air- and water-cooled chillers, hot water boilers, furnaces, AHUs, Cooling Towers, etc.) manufacturers provide performance characteristics of the respective equipment. These characteristics are stored in the HVAC system database (1002 of FIG. 10A). The OLAAM system chooses the optimum operational points at all load conditions, and adjust the parameters for optimum energy performance of the respective equipment. One such example namely the AHRI part load performance characteristics of chillers of different manufacturers are include below in Tables 15 through 18.

TABLE 15

Central Chiller Plant of an Office building including data Center-Manufacturer A
ARI Part Load Performance

| % Capacity | Tons | Power, kW | CHWET ° F. | CHWLT ° F. | CHW Flow, USGPM | CW Flow, USGPM | CWET ° F. | CWLT ° F. | Chiller kW/ Ton |
|---|---|---|---|---|---|---|---|---|---|
| 100% | 900 | 461 | 52.00 | 44 | 2,149 | 2,700 | 85 | 94.3 | 0.51 |
| 90% | 810 | 381 | 51.20 | 44 | 2,149 | 2,700 | 81 | 89.3 | 0.47 |
| 80% | 720 | 315 | 50.40 | 44 | 2,149 | 2,700 | 77 | 84.3 | 0.44 |
| 70% | 630 | 259 | 49.60 | 44 | 2,149 | 2,700 | 73 | 79.3 | 0.41 |
| 60% | 567 | 214 | 48.80 | 44 | 2,149 | 2,700 | 69 | 74.4 | 0.38 |
| 50% | 504 | 172 | 48.00 | 44 | 2,149 | 2,700 | 65 | 69.5 | 0.34 |
| 40% | 441 | 146 | 47.20 | 44 | 2,149 | 2,700 | 65 | 68.6 | 0.33 |
| CHW | Chilled Water | | | | | | | | |
| CW | Condenser Water | | | | | | | | |
| CHWET ° F. | Chilled Water Entry Temperature ° F. | | | | | | | | |
| CHWLT ° F. | Chilled Water Leaving Temperature ° F. | | | | | | | | |
| CWET ° F. | Condenser Water Entry Temperature ° F. | | | | | | | | |
| CWLT ° F. | Condenser Water Leaving Temperature ° F. | | | | | | | | |

20

TABLE 16

Central Chiller Plant of a Hotel-Manufacturer B
ARI Part Load Performance

| % Capacity | Tons | Power kW | CHWE ° F. | CHWLT ° F. | CHW Flow, USGPM | CW Flow, USGPM | CWET ° F. | CWLT ° F. | Chiller kW/ Ton |
|---|---|---|---|---|---|---|---|---|---|
| 100% | 969 | 536 | 52 | 44 | 2,900 | 3,700 | 85 | 92 | 0.55 |
| 90% | 872 | 428 | 51 | 44 | 2,900 | 3,700 | 81 | 87 | 0.49 |
| 80% | 775 | 334 | 50 | 44 | 2,900 | 3,700 | 77 | 83 | 0.43 |
| 70% | 678 | 258 | 50 | 44 | 2,900 | 3,700 | 73 | 78 | 0.38 |
| 60% | 581 | 194 | 49 | 44 | 2,900 | 3,700 | 69 | 73 | 0.33 |
| 50% | 484 | 142 | 48 | 44 | 2,900 | 3,700 | 65 | 69 | 0.29 |
| 40% | 388 | 118 | 47 | 44 | 2,900 | 3,700 | 65 | 68 | 0.31 |
| CHW | Chilled Water | | | | | | | | |
| CW | Condenser Water | | | | | | | | |
| CHWET ° F. | Chilled Water Entry Temperature ° F. | | | | | | | | |
| CHWLT ° F. | Chilled Water Leaving Temperature ° F. | | | | | | | | |
| CWET ° F. | Condenser Water Entry Temperature ° F. | | | | | | | | |
| CWLT ° F. | Condenser Water Leaving Temperature ° F. | | | | | | | | |

TABLE 17

District Cooling Plant-Manufacturer C
ARI Part Load Performance

| % Capacity | Tons | Power kW | CHWET ° F. | CHWLT ° F. | CHW Flow, USGPM | CW Flow, USGPM | CWET ° F. | CWLT ° F. | Chillers kW/ Ton |
|---|---|---|---|---|---|---|---|---|---|
| 100% | 2,640 | 1,820 | 57 | 47.68 | 6,336 | 12,000 | 85 | 92 | 0.69 |
| 90% | 2,376 | 1,461 | 56 | 47.68 | 6,336 | 12,000 | 81 | 87 | 0.62 |
| 80% | 2,112 | 1,181 | 55 | 47.68 | 6,336 | 12,000 | 77 | 83 | 0.56 |
| 70% | 1,848 | 984 | 54 | 47.68 | 6,336 | 12,000 | 73 | 78 | 0.52 |
| 60% | 1,584 | 766 | 53 | 47.68 | 6,336 | 12,000 | 69 | 73 | 0.48 |
| 50% | 1,320 | 615 | 52 | 47.68 | 6,336 | 12,000 | 65 | 69 | 0.47 |
| CHW | Chilled Water | | | | | | | | |
| CW | Condenser Water | | | | | | | | |
| CHWET ° F. | Chilled Water Entry Temperature ° F. | | | | | | | | |
| CHWLT ° F. | Chilled Water Leaving Temperature ° F. | | | | | | | | |
| CWET ° F. | Condenser Water Entry Temperature ° F. | | | | | | | | |
| CWLT ° F. | Condenser Water Leaving Temperature ° F. | | | | | | | | |

TABLE 18

Central Chiller Plant of a Hotel-Manufacturer D
ARI Part Load Performance

| % Capacity | Tons | Power, kW | CHWET ° F. | CHWLT ° F. | CHW Flow, USGPM | CW Flow, USGPM | CWET ° F. | CWLT ° F. | Chiller kW/ Ton |
|---|---|---|---|---|---|---|---|---|---|
| 100% | 420 | 251 | 52 | 44 | 1,198 | 1,621 | 89.6 | 96.6 | 0.60 |
| 75% | 315 | 136 | 50 | 44 | 1,198 | 1,621 | 77.3 | 82.3 | 0.43 |
| 50% | 210 | 59 | 48 | 44 | 1,198 | 1,621 | 65 | 68.2 | 0.28 |
| 25% | 105 | 41 | 46 | 44 | 1,198 | 1,621 | 65 | 66.7 | 0.39 |
| CHW | | | | | Chilled Water | | | | |
| CW | | | | | Condenser Water | | | | |
| CHWET ° F. | | | | | Chilled Water Entry Temperature ° F. | | | | |
| CHWLT ° F. | | | | | Chilled Water Leaving Temperature ° F. | | | | |
| CWET ° F. | | | | | Condenser Water Entry Temperature ° F. | | | | |
| CWLT ° F. | | | | | Condenser Water Leaving Temperature ° F. | | | | |

From Tables 15-18 above, it can be seen that all-manufacturers' chillers reach their maximum efficiency at 50% of its full capacity provided the following conditions are maintained, 1) condenser water entry temperature is maintained at 65° F., 2) Condenser water and chilled water flow are maintained as those of full load, and 3) the leaving water temperature is maintained constant. It should be noted that all manufacturers specify constant chilled and water flows at all % of loads. Many control systems in the market place focus on using VFDs on the pumps to save small amount energy while losing larger amount of energy in the chillers. The OLAAM system eliminates this improper practice. While items 2 and 3 are maintainable by superimposed algorithmic controls, item 1) depends on the ambient dew point/wet bulb. Manufacturers of cooling towers (CT) guarantee a cooling tower return temperature (CWET) of dry bulb temperature+7° F. The OLAAM system will run the CT per manufacturers' specification thereby taking care of the optimization of the weather dependent parameter of CWET.

The key to a sustainable and long-lasting optimization implementation depends on the acceptance of the comforts (provided to the end user), resulting from the optimization project. The operator who provides the service in the plant level will mostly take the path of least resistance of bypassing the implemented optimization project and reverting back to the pre-implementation condition, if any complaint is received on the comfort level.

The loading/unloading and the start/stop of the chillers are controlled only by the temperature of leaving chilled water temperature (CHWLT) from the chillers. The operator sets a fixed CHWLT in the BMS based on personal experience and feedback from the end users. For example, if the BMS is set to deliver CHWLT at 42° F., the BMS will load/unload and start/stop the chiller/s at that temperature. There is no provision in the BMS to adjust for the change in RH which will vary throughout the day.

Almost all the cooling controls currently in practice for the central cooling system be it water cooled or air cooled are based on a constant leaving water/air temperature in indirect or direct expansion chillers respectively. This is a single parameter control whereas the human comfort is affected by two parameters: 1) Temperature, and 2) Relative Humidity. Controlling only by the constant leaving fluid temperature alone does not guarantee human comfort which is also influenced by the humidity in the air. In order to make sure comfort level is maintained the operator tend to overpower the cooling plant by maintaining the lowest obtainable temperatures and running additional all the time. This mode of operation rules out any energy optimization.

The combination of higher humidity (80-95%) and medium (65-75° F.) temperature and vice versa may cause substantial of discomfort if optimized only with temperature. In the absence of a control which can strike a balance of both, the plant operator over powers the system.

The optimization process for power/energy reduction therefore strikes a balance between the temperature and the RH. This is a complicated situation because temperature and RH are inversely proportional. A parameter which can strike an optimum balance between the two opposites is the Dew Point (DP). A DP control algorithm varies with many parameters including outside air temperature and RH, AHU and fresh air unit (FAU) design and construction, air filters, fresh air changes, heat transfer coils, etc. Power draw (kW) is very sensitive to even small changes in DP. Accordingly, the margin for errors is very small with the DP control algorithm unlike control by temperature alone.

OLAAM is a holistic control algorithm to dynamically control supply side (the chillers), demand side (the AHUs and VAVs) and fresh air units based on the DP at all the three areas. Thus, the OLAAM system determines the best two algorithms namely 1) Optimization for energy at the supply side, and 2) Sustainable solution by dew point controls.

At 1036, digital communication between the OLAM system and the customer's BMS is established. One of the unique features of the OLAAM system is its ability act as a master controller to provide control algorithms for energy optimization and sustainability. This feature eliminates the requirements of additional hardware such field instruments, retrofit added hardware for the BMS, and down time for plant shut down. OLAAM not only reduces substantial cost but also completes the project at a shorter time unlike conventional projects. In order to accomplish this feature, the OLAAM system employs registers for the input/output for the required parameters which are already hard wired to the panel of the existing BMS. The parameters may include but limited to 1) Ambient dry bulb temperature, 2) Ambient Relative Humidity (RH %), 3) Remote adjustments of equipment temperature/pressure settings for loading/unloading, 4) Remote adjustment of speed references of VFDs, 5) Remote start/stop of HVAC equipment, etc. The registers may include Modbus registers for the control parameters including those for VFDs.

At 1038, the customer modifies the existing BMS to receive commands from the OLAAM system and to execute the commands. After the command execution, the BMS provides feedback to the OLAAM system. At 1040, the energy optimization per the manufacturer's specification is employed. At 1042, the sustainability (e.g., DP control) algorithm to set points, and to start/stop HVAC equipment is employed.

An OLAAM system computer receives the inputs from the customer BMS via a network (e.g., Cloud), and determines the appropriate action for energy optimization and sustainability. While the OLAAM system receives the inputs on a continual basis, the commands to execute an order will be given periodically, the frequency of which will be determined on a case by case basis.

At 1044, the OLAAM system creates supervisory control and data acquisition (SCADA) images and reporting functions for the particular application. At 1046, the OLAAM system is administers the project with regular data collection, savings calculation, tabulation, reporting, and invoicing.

Figure 15:
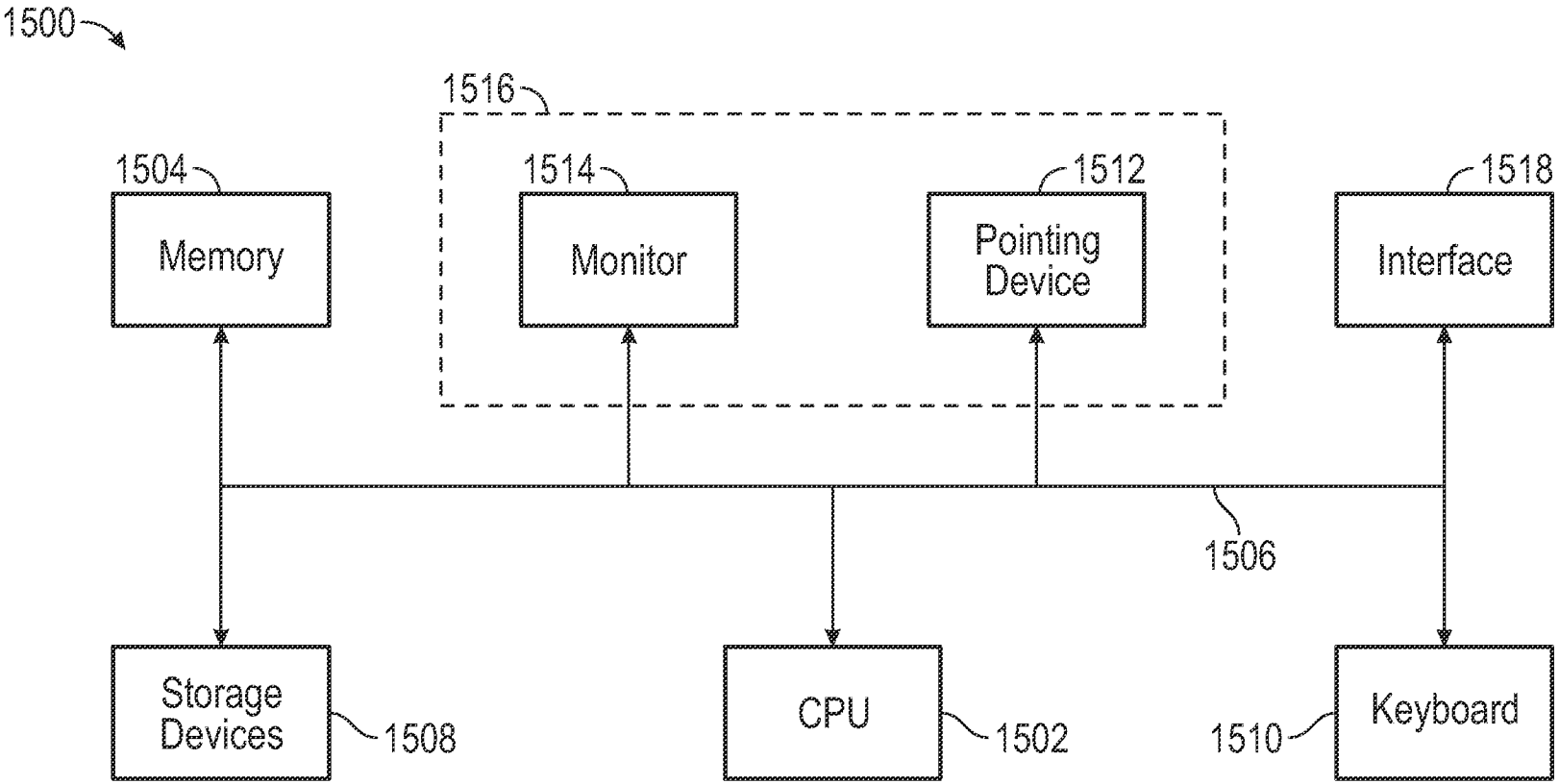
FIG. 15 is a simplified block diagram of a computing environment in which embodiments of the present disclosure can be implemented.

FIG. 15 and the related discussion provide a brief, general description of a suitable computing environment in which embodiments of the present disclosure can be implemented. Although not required, components of the OLAAM system can be implemented at least in part, in the general context of computer-executable instructions, such as program modules, being executed by a computer 1500 which may be connected in wired or wireless fashion to the BMS system. Generally, program modules include routine programs, objects, components, data structures, etc., which perform particular tasks or implement particular abstract data types. Those skilled in the art can implement the description herein as computer-executable instructions storable on a non-transitory computer readable medium. Moreover, those skilled in the art will appreciate that the OLAAM system may be practiced with other computer system configurations, including multiprocessor systems, networked personal computers, mini computers, main frame computers, and the like. Aspects of the OLAAM system may also be practiced in distributed computing environments where tasks are performed by remote processing devices that are linked through a communications network. In a distributed computer environment, program modules may be located in both local and remote memory storage devices.

The computer 1500 comprises a conventional computer having a central processing unit (CPU) 1502, memory 1504 and a system bus 1506, which couples various system components, including memory 1504 to the CPU 1502. The system bus 1506 may be any of several types of bus structures including a memory bus or a memory controller, a peripheral bus, and a local bus using any of a variety of bus architectures. The memory 1504 includes read only memory (ROM) and random access memory (RAM). A basic input/output (BIOS) containing the basic routine that helps to transfer information between elements within the computer 1500, such as during start-up, is stored in ROM. Storage devices 1508, such as a hard disk, a floppy disk drive, an optical disk drive, etc., are coupled to the system bus 1506 and are used for storage of programs and data. It should be appreciated by those skilled in the art that other types of computer readable media that are accessible by a computer, such as magnetic cassettes, flash memory cards, digital video disks, random access memories, read only memories, and the like, may also be used as storage devices. Commonly, programs (including the OLAAM system programs) are loaded into memory 1504 from at least one of the storage devices 1508 with or without accompanying data.

Input devices such as a keyboard 1510 and/or pointing device (e.g., mouse, joystick(s)) 1512, or the like, allow the user to provide commands to the computer 1500. A monitor 1514 or other type of output device can be further connected to the system bus 1506 via a suitable interface and can provide feedback to the user. If the monitor 1514 is a touch screen, the pointing device 1512 can be incorporated therewith. The monitor 1514 and input pointing device 1512 such as mouse together with corresponding software drivers can form a graphical user interface (GUI) 1516 for computer 1500. Interfaces 1518 allow communication to other computer systems if necessary. Interfaces 1518 also represent circuitry used to send signals to or receive signals from the actuators and/or sensing devices mentioned above. Commonly, such circuitry comprises digital-to-analog (D/A) and analog-to-digital (A/D) converters as is well known in the art.

Figure 16:
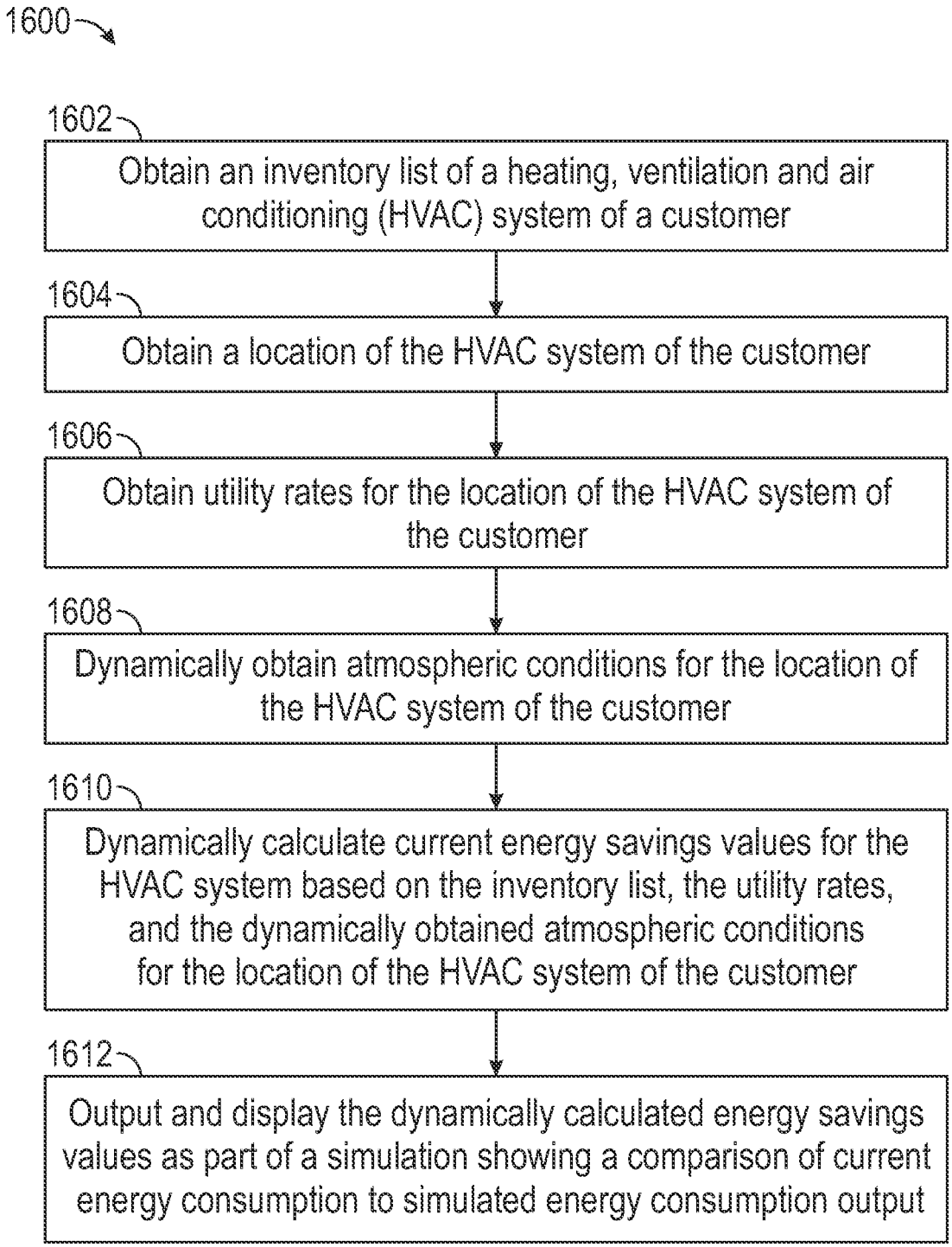
FIG. 16 is a flow diagram of a method embodiment.

FIG. 16 is a flow chart of a method 1600 in accordance with another embodiment. At 1602, an inventory list of a heating, ventilation and air conditioning (HVAC) system of a customer is obtained by a processor of a computer such as 1600. At 1064, a location of the HVAC system of the customer is obtained by the processor of the computer. At 1606, utility rates for the location of the HVAC system of the customer are obtained by the processor of the computer. At 1608, atmospheric conditions for the location of the HVAC system of the customer are dynamically obtained by the processor of the computer. At 1610, current energy savings values for the HVAC system based on the inventory list, the utility rates, and the dynamically obtained atmospheric conditions for the location of the HVAC system of the customer are dynamically calculated by the processor of the computer. At 1612, the dynamically calculated energy savings values are output and displayed by the computer as part of a simulation showing a comparison of current energy consumption to simulated energy consumption output (e.g., FIGS. 13A and 14 are displayed side-by-side on a monitor such as 1514 of FIG. 15).

The illustrations of the embodiments described herein are intended to provide a general understanding of the structure of the various embodiments. The illustrations are not intended to serve as a complete description of all of the elements and features of apparatus and systems that utilize the structures or methods described herein. Features described with respect to any embodiment also apply to any other embodiment. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be reduced. Accordingly, the disclosure and the figures are to be regarded as illustrative rather than restrictive.

One or more embodiments of the disclosure may be referred to herein, individually and/or collectively, by the term "invention" merely for convenience and without intending to limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description. All patent documents mentioned in the description are incorporated by reference.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments employ more features than are expressly recited in each claim. Rather, as the following claims reflect, inventive subject matter may be directed to less than all of the features of any of the disclosed embodiments.

The above-disclosed subject matter is to be considered illustrative, and not restrictive, and the appended claims are intended to cover all such modifications, enhancements, and other embodiments, which fall within the true spirit and scope of the present disclosure. For example, features described with respect to one embodiment may be incorporated into other embodiments. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A method comprising:

executing an online assessment and manifestation (OLAAM) system in a first computer, the OLAAM system being capable of assessing energy savings of any of a plurality of a heating, ventilation and air conditioning (HVAC) systems that operate independently of each other and independently of the OLAAM system;

receiving, in the first computer, a digital screen capture of a representation of a-one of the plurality of HVAC systems depicting different elements of the HVAC system, interconnections between the different elements, and current operating parameters employed for the different elements;

performing, by a processor of the first computer executing the OLAAM system, an image recognition operation on the digital screen capture that:

identifies the depicted elements; and recognizes the depicted current operating parameters for the different depicted elements;

analyzing, by the processor of the first computer executing the OLAAM system, the different recognized current operating parameters to determine current energy consumption values for the HVAC system;

calculating, by the processor of the first computer executing the OLAAM system, obtainable energy savings values for the HVAC system based on the identified depicted elements, the different recognized current operating parameters, and the current energy consumption values; and outputting the energy savings values.

2. The method of claim 1 and wherein the image recognition operation identifies the depicted different elements of the HVAC system by comparing the depicted different elements of the HVAC system with elements in a HVAC system database, and wherein the image recognition operation recognizes the depicted current operating parameters for the different depicted elements using the HVAC system database.

3. The method of claim 1 and wherein calculating the obtainable energy savings values comprises determining the obtainable energy savings values based on a comparison of a part-load kilowatts (kW)/Ton value for at least one of the depicted different elements of the HVAC system with a full-load kW/Ton value for the at least one of the depicted different elements of the HVAC system.

4. The method of claim 3 and further comprising refining the determined obtainable energy savings values based on utility tariff data.

5. The method of claim 3 and further comprising obtaining, by the processor of the first computer, historical weather data for a location of the HVAC system.

6. The method of claim 5 and further comprising refining the determined obtainable energy savings values based on the historical weather data.

7. The method of claim 6 and wherein refining the determined obtainable energy savings values based on the historical weather data comprises refining the determined obtainable energy savings values based on dew point data.

8. The method of claim 7 and further comprising determining at least one algorithm to implement the obtainable energy savings values.

9. The method of claim 8 and further comprising establishing a digital communication link between the first computer and a second computer that manages the HVAC system.

10. The method of claim 9 and further comprising employing, by the first computer, the at least one algorithm to implement the obtainable energy savings values via the second computer.

11. The method of claim 10 and wherein the at least one algorithm is based on manufacturer specifications for HVAC equipment.

12. The method of claim 10 and wherein the at least one algorithm enables dew point-based operation control of one or more of the different elements of the HVAC system.

13. The method of claim 10 and further comprising monitoring operation of the HVAC system by the first and second computers.

14. A system comprising:

a memory configured to store a heating, ventilation and air conditioning (HVAC) system database; and a processor communicatively coupled to the memory, the processor configured to:

execute an online assessment and manifestation (OLAAM) system, the OLAAM system being capable of assessing energy savings of any of a plurality of HVAC systems that operate independently of each other and independently of the OLAAM system;

receive a digital screen capture of a representation of one of the plurality of HVAC systems depicting different elements of the HVAC system, interconnections between the different elements, current operating parameters employed for the different elements, and outdoor ambient conditions of the environment in which the HVAC system is employed;

perform an image recognition operation on the digital screen capture that:

compares the depicted different elements of the HVAC system with elements in the HVAC system database to identify the depicted elements;

recognizes, using the HVAC system database, the depicted current operating parameters for the different depicted elements; and recognizes, using the HVAC system database, the depicted outdoor ambient conditions of the environment in which the HVAC system is employed;

analyze the different recognized current operating parameters to determine current energy consumption values for the HVAC system;

calculate obtainable energy savings values for the HVAC system based on the identified depicted elements, the different recognized current operating parameters, and the current energy consumption values; and output the energy savings values.

15. The system of claim 14 and wherein the processor is further configured to calculate the obtainable energy savings values by determining the obtainable energy savings values based on a comparison of a part-load kilowatts (kW)/Ton value for at least one of the depicted different elements of the HVAC system with a full-load kW/Ton value for the at least one of the depicted different elements of the HVAC system.

16. The system of claim 15 and wherein the processor is further configured to refine the determined obtainable energy savings values based on utility tariff data.

17. The system of claim 15 and wherein the processor is further configured to refine the determined obtainable energy savings values based on historical weather data for a location of the HVAC system.

18. The system of claim 17 and wherein the processor is configured to refine the determined obtainable energy savings values based on the historical weather data by refining the determined obtainable energy savings values based on dew point data.

19. The system of claim 18 and wherein the processor is communicatively coupled to a computer that manages the HVAC system, and wherein the processor is further configured to implement energy savings in the HVAC system by executing at least one algorithm determined based the obtainable energy savings values.

20. A method comprising:

executing an online assessment and manifestation (OLAAM) system in a computer, the OLAAM system being capable of assessing energy savings of any of a plurality of a heating, ventilation and air conditioning (HVAC) systems that operate independently of each other and independently of the OLAAM system;

providing, by the first computer, a high-level energy savings estimate for one of the plurality of HVAC systems; and providing a detailed energy savings estimate for the HVAC system one of the plurality of HVAC systems by:

receiving, in the computer, a digital screen capture of a representation of the HVAC system depicting different elements of the HVAC system, interconnections between the different elements, current operating parameters employed for the different elements, and outdoor ambient conditions of the environment in which the HVAC system is employed;

performing, by a processor of the computer executing the OLAAM system, an image recognition operation on the digital screen capture that:

compares the depicted different elements of the HVAC system with elements in a HVAC system database to identify the depicted elements;

recognizes, using the HVAC system database, the depicted current operating parameters for the different depicted elements; and recognizes, using the HVAC system database, the depicted outdoor ambient conditions of the environment in which the HVAC system is employed;

analyzing, by the processor of the computer executing the OLAAM system, the different recognized current operating parameters to determine current energy consumption values for the HVAC system;

calculating, by the processor of the computer executing the OLAAM system, obtainable energy savings values for the HVAC system based on the identified depicted elements, the different recognized current operating parameters, and the current energy consumption values; and outputting the calculated energy savings values that constitute that detailed energy savings.

21. The method of claim 1 and wherein outputting the energy savings values comprises displaying the energy savings values as part of a simulation showing a comparison of current energy consumption to simulated energy consumption.

* * * * *